US010780563B2

(12) United States Patent
Ichikawa et al.

(10) Patent No.: US 10,780,563 B2
(45) Date of Patent: Sep. 22, 2020

(54) ELECTRIC POWER TOOL AND METHOD OF CONTROLLING ROTATIONAL SPEED OF MOTOR IN ELECTRIC POWER TOOL

(71) Applicant: MAKITA CORPORATION, Anjo-shi, Aichi (JP)

(72) Inventors: Yoshitaka Ichikawa, Anjo (JP); Hirokatsu Yamamoto, Anjo (JP); Ryo Umemoto, Anjo (JP); Kunihisa Shima, Anjo (JP)

(73) Assignee: MAKITA CORPORATION, Anjo-Shi (JP)

( * ) Notice: Subject to any disclaimer, the term of this patent is extended or adjusted under 35 U.S.C. 154(b) by 181 days.

(21) Appl. No.: 15/724,766

(22) Filed: Oct. 4, 2017

(65) Prior Publication Data

US 2018/0099394 A1 Apr. 12, 2018

(30) Foreign Application Priority Data

Oct. 7, 2016 (JP) ..... 2016-199173

(51) Int. Cl.
*B25D 16/00* (2006.01)
*B25D 17/24* (2006.01)
*B25D 17/04* (2006.01)

(52) U.S. Cl.
CPC ..... *B25D 16/006* (2013.01); *B25D 17/043* (2013.01); *B25D 17/24* (2013.01);
(Continued)

(58) Field of Classification Search
CPC .... B25D 2216/0023; B25D 2216/0084; B25D 2222/72; B25D 16/006; B25D 2250/121; B25D 2250/221; B25D 2250/265
See application file for complete search history.

(56) References Cited

U.S. PATENT DOCUMENTS 4,574,226 A 3/1986 Binder
5,584,619 A 12/1996 Guzzella
(Continued)

FOREIGN PATENT DOCUMENTS

JP S60-077694 A 5/1985
JP H7-253192 A 10/1995
(Continued)

OTHER PUBLICATIONS

Mar. 13, 2020 Office Action Issued in U.S. Appl. No. 15/723,587.
(Continued)

*Primary Examiner* — Robert F Long
*Assistant Examiner* — Xavier A Madison
(74) *Attorney, Agent, or Firm* — Oliff PLC

(57) ABSTRACT

An electric power tool according to one aspect of the present disclosure includes a main body, a motor, a tool holder configured to hold a tool bit, a hammer, a motion converter, a rotation transmitter, a first load detector, a second load detector, and a motor controller. The first load detector detects, based on information indicating a drive state of the motor, a load imposed from a work piece to the tool bit. The second load detector detects, based on information indicating a behavior of the main body, a load imposed from the work piece to the tool bit. The motor controller sets an upper limit of rotational speed of the motor to a predetermined no-load rotational speed in response to no-load on the tool bit being detected by both the first load detector and the second load detector.

17 Claims, 16 Drawing Sheets

(52) U.S. Cl.
CPC ..... *B25D 2211/068* (2013.01); *B25D 2216/0015* (2013.01); *B25D 2216/0023* (2013.01); *B25D 2216/0038* (2013.01); *B25D 2216/0084* (2013.01); *B25D 2222/72* (2013.01); *B25D 2250/121* (2013.01); *B25D 2250/201* (2013.01); *B25D 2250/221* (2013.01); *B25D 2250/265* (2013.01)

(56) References Cited

U.S. PATENT DOCUMENTS

| | | | | |
|---|---|---|---|---|
| 5,914,882 | A * | 6/1999 | Yeghiazarians | F16P 3/00 408/1 R |
| 6,060,850 | A | 5/2000 | Sakabe | |
| 6,076,616 | A | 6/2000 | Kramp et al. | |
| 6,843,326 | B2 | 1/2005 | Tambini | |
| 7,410,006 | B2 | 8/2008 | Zhang et al. | |
| 7,882,899 | B2 | 2/2011 | Borinato et al. | |
| 8,316,958 | B2 | 11/2012 | Schell et al. | |
| 8,469,115 | B2 | 6/2013 | Kondo et al. | |
| 9,126,321 | B2 | 9/2015 | Muller et al. | |
| 9,505,097 | B2 | 11/2016 | Aoki et al. | |
| 2002/0003045 | A1 | 1/2002 | Bongers-Ambrosius | |
| 2004/0119431 | A1 | 6/2004 | Kawano et al. | |
| 2004/0177981 | A1 | 9/2004 | Berger | |
| 2004/0236500 | A1 | 11/2004 | Choi et al. | |
| 2005/0023017 | A1 | 2/2005 | Sakai | |
| 2006/0124331 | A1 | 6/2006 | Stirm et al. | |
| 2008/0319570 | A1 | 12/2008 | Van Schoiack | |
| 2009/0321101 | A1 | 12/2009 | Furusawa et al. | |
| 2011/0114345 | A1 | 5/2011 | Schlesak et al. | |
| 2011/0114347 | A1* | 5/2011 | Kasuya | B25D 11/005 173/11 |
| 2011/0186323 | A1 | 8/2011 | Schneider et al. | |
| 2011/0203821 | A1 | 8/2011 | Puzio et al. | |
| 2011/0284255 | A1* | 11/2011 | Ookubo | B23B 45/02 173/109 |
| 2011/0308827 | A1 | 12/2011 | Kaufmann | |
| 2012/0048580 | A1 | 3/2012 | Appel et al. | |
| 2012/0103643 | A1 | 5/2012 | Binder et al. | |
| 2012/0137776 | A1 | 6/2012 | Ogihara et al. | |
| 2012/0255756 | A1 | 10/2012 | Aoki | |
| 2012/0279740 | A1 | 11/2012 | Furusawa et al. | |
| 2012/0289377 | A1 | 11/2012 | Aoki | |
| 2012/0318545 | A1 | 12/2012 | Schreiber | |
| 2013/0092408 | A1 | 4/2013 | Oberheim | |
| 2013/0140050 | A1 | 6/2013 | Eshleman et al. | |
| 2013/0186661 | A1 | 7/2013 | Okubo et al. | |
| 2013/0319710 | A1 | 12/2013 | Aoki et al. | |
| 2014/0174777 | A1 | 6/2014 | Kakiuchi et al. | |
| 2014/0196920 | A1 | 7/2014 | Wirnitzer et al. | |
| 2014/0216773 | A1 | 8/2014 | Steurer | |
| 2014/0231113 | A1 | 8/2014 | Steurer | |
| 2015/0000944 | A1 | 1/2015 | Duesselberg et al. | |
| 2015/0129248 | A1 | 5/2015 | Nitsche et al. | |
| 2015/0231771 | A1 | 8/2015 | Sakai et al. | |
| 2015/0246438 | A1 | 9/2015 | Aoki | |
| 2015/0372633 | A1 | 12/2015 | Machida et al. | |
| 2016/0121466 | A1 | 5/2016 | Kiyohara et al. | |
| 2016/0151905 | A1 | 6/2016 | Tada et al. | |
| 2016/0279776 | A1 | 9/2016 | Wirnitzer et al. | |
| 2016/0279782 | A1 | 9/2016 | Ullrich et al. | |
| 2016/0354911 | A1 | 12/2016 | Aoki et al. | |
| 2018/0304453 | A1 | 10/2018 | Schaer et al. | |
| 2018/0370008 | A1 | 12/2018 | Peters et al. | |
| 2019/0061081 | A1 | 2/2019 | Schaer | |

FOREIGN PATENT DOCUMENTS

| | | | |
|---|---|---|---|
| JP | H10-248284 | A | 9/1998 |
| JP | 2004-194422 | A | 7/2004 |
| JP | 2005-353004 | A | 12/2005 |
| JP | 2008-178935 | A | 8/2008 |
| JP | 2011-041187 | A | 2/2011 |
| JP | 2011-104736 | A | 6/2011 |
| JP | 2012-076160 | A | 4/2012 |
| JP | 2012-80411 | A | 4/2012 |
| JP | 2014-069264 | A | 4/2014 |
| JP | 2014-148001 | A | 8/2014 |
| JP | 2015-009302 | A | 1/2015 |
| JP | 2015-066635 | A | 4/2015 |
| JP | 2015-517411 | A | 6/2015 |
| JP | 2015-150664 | A | 8/2015 |
| JP | 2015-169582 | A | 9/2015 |
| WO | 2014208125 | A1 | 12/2014 |

OTHER PUBLICATIONS

Mar. 19, 2020 Office Action Issued in U.S. Appl. No. 15/720,451.
Sep. 4, 2019 Office Action Issued in U.S. Appl. No. 15/723,587.
Sep. 11, 2019 Office Action issued in U.S. Appl. No. 15/720,451.
Endevco, "Steps to Selecting the Right Accelerometer", website: https://www.endevco.com/news/newsletter/2012_07/tp327.pdf, (Year: 2012).
Dec. 20, 2019 Office Action issued in U.S. Appl. No. 15/723,757.
Apr. 28, 2020 Office Action issued in Japanese Patent Application No. 2016-199175.
May 19, 2020 Office Action issued in Japanese Patent Application No. 2016-199176.
Jun. 8, 2020 Advisory Action issued in U.S. Appl. No. 15/723,587.
Jul. 7, 2020 Notice of Reasons for Rejection issued in Japanese Patent Application No. 2016-199173.
Jul. 9, 2020 Office Action issued in U.S. Appl. No. 15/720,451.

* cited by examiner

ELECTRIC POWER TOOL AND METHOD OF CONTROLLING ROTATIONAL SPEED OF MOTOR IN ELECTRIC POWER TOOL

CROSS-REFERENCE TO RELATED APPLICATIONS

This application claims the benefit of Japanese Patent Application No. 2016-199173, filed on Oct. 7, 2016; the entire disclosure of which is incorporated herein by reference.

BACKGROUND

The present disclosure relates to an electric power tool.

The hammer drill disclosed in Japanese Unexamined Patent Application Publication No. 2008-178935 is configured to perform so-called soft no load control. Under soft no load control, when a tip tool, such as a hammer bit, is out of contact with a work piece and a load is not imposed on the tip tool (i.e., no load is imposed on the tip tool), a motor is rotated at a low rotational speed independently of a command from a user.

SUMMARY

To perform such soft no load control, whether a tip tool is under load conditions should be detected. In addition, to detect a load imposed on the tip tool, as disclosed in the above mentioned Publication, current flowing through the motor is usually used.

To be specific, when the value of current flowing through the motor reaches a predetermined value, the hammer drill determines that the tip tool is under load conditions, and increases the rotational speed of the motor from a low rotational speed that is given when the tip tool is under no-load conditions.

However, when the drive mode of the hammer drill is set to the hammer mode in which the tip tool is not rotated but caused to only perform a hammering operation and the tip tool is under load conditions, current does not dramatically increase.

For this reason, in the hammer mode, a load on the tip tool due to hammering cannot be detected and the motor cannot be rotated at high speed for hammering in some cases.

It is preferable in one aspect of the present disclosure to detect a load imposed from a work piece to a tool bit and increase a rotational speed of a motor when an electric power tool is operated in a hammer mode in which the electric power tool performs only a hammering operation.

An electric power tool of one aspect of the present disclosure includes a main body, a motor, a tool holder, a hammer, a motion converter, a rotation transmitter, a first load detector, a second load detector, and a motor controller. The motor is provided to the main body. The tool holder is provided to the main body and holds a tool bit such that the tool bit is reciprocatable in an axial direction of the tool bit. The hammer is provided to the main body and reciprocates the tool bit held by the tool holder in the axial direction to hammer a work piece.

The motion converter is provided to the main body and converts rotation of the motor to linear motion and transmits the linear motion to the hammer. The rotation transmitter is provided to the main body and transmits the rotation of the motor to the tool holder and rotatively drives the tool bit in a circumferential direction of the tool bit.

The first load detector detects, based on information indicating a drive state of the motor, a load imposed from the work piece to the tool bit. The second load detector detects, based on information indicating the behavior of the main body, a load imposed from the work piece to the tool bit.

The motor controller controls drive of the motor based on a command rotational speed commanded from an outside of the electric power tool. The motor controller sets an upper limit of rotational speed of the motor to a predetermined no-load rotational speed in response to no-load on the tool bit being detected by both the first load detector and the second load detector.

In the electric power tool with this configuration, even when the electric power tool is operated in a drive mode in which the electric power tool performs only a hammering operation, a load imposed from the work piece to the tool bit is detected and the motor can be driven at the command rotational speed.

The electric power tool may include a mode switcher that is configured to selectively set a drive mode of the tool bit to any one of a hammer mode, a hammer drill mode, and a drill mode. The hammer mode is a mode in which the tool bit reciprocates in the axial direction, the hammer drill mode is a mode in which the tool bit reciprocates in the axial direction and rotates in the circumferential direction, and the drill mode is a mode in which the tool bit rotates in the circumferential direction.

During the drive mode is set to the hammer drill mode or the drill mode and the tool bit is in rotation, current flowing through the motor increases upon the tool bit being in contact with the work piece and imposed with a load. Consequently, the first load detector can detect a load on the tool bit based on the drive state of the motor.

In the hammer mode, the tool bit only reciprocates in the axial direction. Hence, even if the tool bit hammers the work piece and a load is imposed from the work piece to the tool bit, the drive state of the motor does not dramatically change. Accordingly, the first load detector cannot detect a load on the tool bit in some cases.

When the drive mode is set to the hammer mode or the hammer drill mode, hammering the work piece with the tool bit applies a reaction force to the main body due to hammering, so that the main body vibrates.

For this reason, the electric power tool includes the second load detector in addition to the first load detector.

In the electric power tool, in any drive mode selected from the group including the hammer mode, the hammer drill mode, and the drill mode, a load on the tool bit can be rapidly detected and a motor can be driven at a command rotational speed.

The mode switcher may be configured in any manner to selectively set the drive mode and may be, for example, configured to selectively transmit the rotation of the motor to the motion converter and/or the rotation transmitter to selectively set the drive mode.

The first load detector may include a current detector configured to detect a value of current flowing through the motor. In this case, the first load detector may detect a load on the tool bit in response to the value of the current detected by the current detector exceeding a predetermined first threshold.

The second load detector may include an acceleration sensor that is configured to detect at least acceleration of the main body in the axial direction of the tool bit. In this case, the second load detector may detect a load on the tool bit in response to acceleration detected by the acceleration sensor exceeding a predetermined second threshold.

The acceleration sensor may output a detection signal indicating the detected acceleration. In this case, the second load detector may detect a load on the tool bit based on an acceleration that is calculated based on the detection signal with an unwanted low-frequency signal component removed by a high-pass filter.

The high-pass filter may include an analog filter or digital filter.

If the high-pass filter includes the digital filter, a higher accuracy of detecting the acceleration can be obtained than in the case where the analog filter removes the unwanted signal component from the detection signal.

To be more specific, if the high-pass filter includes the analog filter, it may take time to stabilize the detection signal outputted from a circuit including the high-pass filter, since a reference voltage of the circuit may rapidly increase from 0 V to a specified voltage immediately after the electric power tool is supplied with electric power.

If the detection signal is subjected to the filtering process by the digital filter, a signal level of the detection signal immediately after the supply of electric power can be set to an initial value, so that fluctuations in the detection signal (data) can be reduced.

Consequently, the acceleration can be accurately detected from immediately after the supply of electric power to the electric power tool. Thus, the risk that a load on the tool bit cannot be detected due to a detection error of the acceleration can be reduced.

The first load detector may measure a first time and a second time, detect a load on the tool bit in response to the first time reaching a first threshold time, and detect no-load on the tool bit in response to the second time reaching a second threshold time. The first time is a time period during which the value of the current exceeds the first threshold, the second time is a time period during which the value of the current is at or below the first threshold, and the first threshold time and the second threshold time are different from each other.

The second load detector may measure a third time and a fourth time, detect a load on the tool bit in response to the third time reaching a third threshold time, and detect no-load on the tool bit in response to the fourth time reaching a fourth threshold time. The third time is a time period during which the acceleration exceeds the second threshold, the fourth time is a time period during which the acceleration is at or below the second threshold, and the third threshold time and the fourth threshold time are different from each other.

Setting a time required for determining a load or no-load on the tool bit as described above can reduce failures in determination of a load or no-load on the tool bit caused by noise and the like.

The first threshold time may be shorter than the second threshold time. The third threshold time may be shorter than the fourth threshold time. In this case, a load on the tool bit can be detected earlier than no-load on the tool bit. Thus, the delay time upon switching of the rotational speed of the motor from the no-load rotational speed to the command rotational speed can be shortened.

Accordingly, the rotational speed of the motor rapidly rises when a load is imposed on the tool bit, allowing chipping or drilling of the work piece to be satisfactorily performed. In addition, for example, switching of the rotational speed of the motor to low speed due to the detection of no-load on the tool bit can be restrained in the middle of chipping operation. In other words, in the electric power tool, a reduction in work efficiency can be restrained.

The second load detector may be separated from the motor controller. For example, the second load detector may be installed in a portion of the main body where large vibration occurs, while the motor controller may be installed in a portion of the main body where large vibration is less likely to occur. In this case, the second load detector can readily detect vibrations of the main body, while the motor controller can restrain degradations due to vibrations of the main body.

The motor controller may rotate the motor at a constant speed corresponding to the command rotational speed or the no-load rotational speed.

The electric power tool may include an upper-limit speed setter that is configured to be operated by an operator of the electric power tool and set an upper limit of the command rotational speed, and a speed change commander that is configured to be operated by the operator and change the command rotational speed in accordance with an amount of operation.

In this case, the motor controller may set the command rotational speed according to the amount of operation of the speed change commander, using the upper limit, which is set by the upper-limit speed setter, as a maximum rotational speed.

With such a configuration, the operator can set the maximum rotational speed of the motor through the upper-limit speed setter, and command to set a given rotational speed at or below the set maximum rotational speed as the command rotational speed, thereby increasing usability of the electric power tool.

The no-load rotational speed may be a constant rotational speed. In this case, the upper-limit speed setter may be able to set upper limit of the command rotational speed to a rotational speed in a range of a rotational speed higher than the no-load rotational speed to a rotational speed lower than the no-load rotational speed.

With such a configuration, the operator can set the command rotational speed to a rotational speed lower than the no-load rotational speed, thereby setting the operating characteristics of the electric power tool variously.

The motor controller may gradually change the rotational speed of the motor upon switching from no-load conditions to load conditions and/or from the load conditions to the no-load conditions. The no-load conditions are conditions in which no-load on the tool bit is detected, and the load conditions are conditions in which a load on the tool bit is detected.

With such a configuration, when the tool bit is made in contact with the work piece or separated from the work piece, a rapid change in the rotational speed of the motor and thus a strangeness that the operator feels can be restricted.

To gradually change the rotational speed of the motor, for example, either a rate (i.e., gradient) of change of the command rotational speed or a rate (i.e., gradient) of change of a duty ratio of a Pulse Width Modulation (PWM) signal used to drive the motor may be limited. Also, a rate (i.e., gradient) of change of current flowing through the motor may be limited.

The main body may be able to be attached with an external unit. Examples of the external unit may include a dust collector device, a water injection device, a lighting device, and a blower. Attaching the external unit to the main body hinders vibrations of the main body in some cases. In other words, attaching the external unit to the main body decreases a load detection sensitivity of the second load detector.

Accordingly, the motor controller may change, in response to the external unit being attached to the main body, conditions under which the upper limit of the rotational speed of the motor is set to the no-load rotational speed.

The motor controller may change the conditions such as the threshold and the like for load determination such that the upper limit of the rotational speed of the motor is barely set to the no-load rotational speed.

The motor controller may control, in response to the external unit being attached to the main body, drive of the motor in accordance with the command rotational speed independently of detection results from the first load detector and the second load detector.

In this case, since the external unit is attached to the main body, when the second load detector cannot detect a load on the tool bit based on the behavior of the main body, the risk that the motor cannot be driven at the command rotational speed can be reduced.

Another aspect of the present disclosure is a method of controlling a rotational speed of a motor of an electric power tool. The method includes detecting, based on first information indicating a drive state of the motor, a load imposed from a work piece to the tool bit, the motor being provided to a main body of the electric power tool, the tool bit being provided to the main body so as to reciprocate in an axial direction of the tool bit and so as to rotate in a circumferential direction of the tool bit; detecting, based on second information indicating a behavior of the main body, a load imposed from the work piece to the tool bit; and setting an upper limit of rotational speed of the motor to a predetermined no-load rotational speed in response to no-load imposed from the work piece to the tool bit being detected based on both the first information and the second information.

Such a method can provide effects similar to those provided by the above-described electric power tool.

BRIEF DESCRIPTION OF THE DRAWINGS

An example embodiment of the present disclosure will be described hereinafter with reference to the accompanying drawings, in which.

DETAILED DESCRIPTION OF THE PREFERRED EMBODIMENTS

A hammer drill 2 of this embodiment is configured to perform chipping or drilling on a work piece (e.g., concrete) by a hammering by a tool bit 4, such as a hammer bit, along the longer axis of the tool bit 4 or rotating it about the longer axis.

Figure 1:
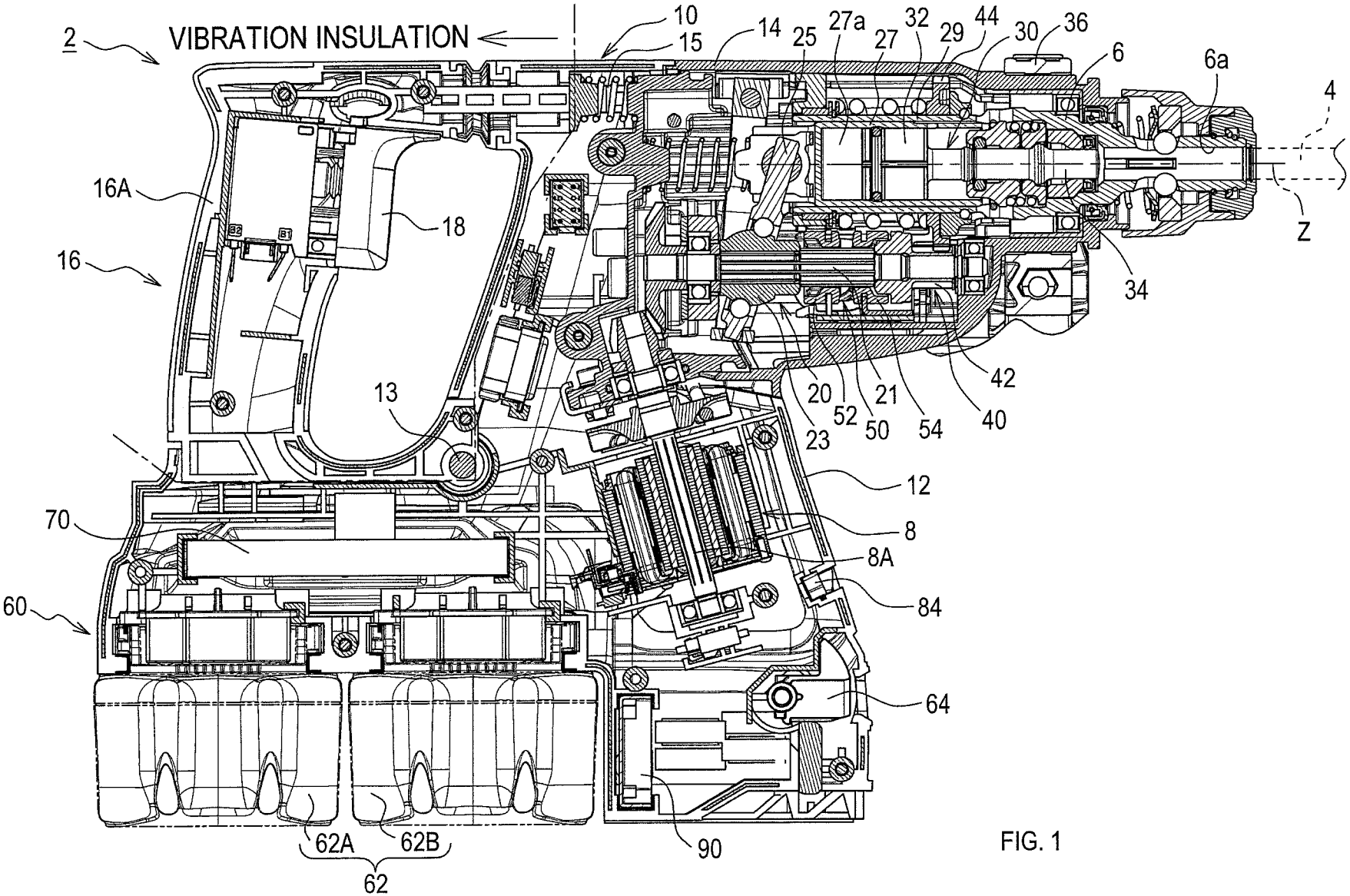
FIG. 1 is a cross-sectional view of a structure of a hammer drill of one embodiment.

As shown in FIG. 1, the hammer drill 2 includes a main body housing 10 defining the contour of the hammer drill 2. The tool bit 4 is detachably attached to the tip of the main body housing 10 through a tool holder 6. The tool holder 6 has a cylindrical shape.

The tool bit 4 is inserted in a bit insertion hole 6*a* in the tool holder 6 and held by the tool holder 6. The tool bit 4 can reciprocate along the longer axis of the tool bit 4 against the tool holder 6 but its rotational motion about the longer axis of the tool bit 4 against the tool holder 6 is restricted.

The main body housing 10 includes a motor housing 12 and a gear housing 14. The motor housing 12 houses a motor 8. The gear housing 14 houses a motion converting mechanism 20, a hammering element 30, a rotation transmitting mechanism 40, and a mode switching mechanism 50.

The main body housing 10 is connected to a hand grip 16 on the opposite side to the tool holder 6. The hand grip 16 includes a hold part 16A which is held by an operator. This hold part 16A extends in a direction orthogonal to the longer axis of the tool bit 4 (i.e., the center shaft of the tool holder 6) (the vertical direction in FIG. 1), and a part of the hold part 16A is on the extension (i.e., the longer axis) of the tool bit 4.

A first end of the hold part 16A (i.e., the end adjacent to the longer axis of the tool bit 4) is connected to the gear housing 14, and a second end of the hold part 16A (i.e., the end remote from the longer axis of the tool bit 4) is connected to the motor housing 12.

The hand grip 16 is fixed to the motor housing 12 such that it can swing about a support shaft 13. The hand grip 16 and the gear housing 14 are connected to each other through a vibration-insulating spring 15.

The spring 15 restrains vibrations that occur in the gear housing 14 (i.e., the main body housing 10) due to a hammering operation of the tool bit 4, so that vibrations from the main body housing 10 to the hand grip 16 are restrained.

In the description below, for convenience of description, the side on which the tool bit 4 is disposed along the longer axis direction parallel with the longer axis of the tool bit 4 is defined as the front side. The side on which the hand grip 16 is disposed along the longer axis direction is defined as the back side. The side on which a joint between the hand grip 16 and the gear housing 14 is disposed along a direction which is orthogonal to the longer axis direction and in which the hold part 16A extends (i.e., the vertical direction of FIG. 1) is defined as the upper side. The side on which a joint between the hand grip 16 and the motor housing 12 is disposed along the vertical direction of FIG. 1 is defined as the lower side.

Further, in the description below, the Z axis is defined as an axis that extends along the longer axis of the tool bit 4 (i.e., the center shaft of the tool holder 6), the Y axis is defined as an axis that is orthogonal to the Z axis and extends in the vertical direction, and the X axis is defined as an axis that is orthogonal to the Z axis and the Y axis and extends in the horizontal direction (i.e., the width direction of the main body housing 10) (see FIG. 2).

In the main body housing 10, the gear housing 14 is disposed on the front side and the motor housing 12 is disposed on the lower side of the gear housing 14. In addition, the hand grip 16 is joined to the back side of the gear housing 14.

In this embodiment, the motor 8 housed in the motor housing 12 is a brushless motor but not limited to a brushless motor in the present disclosure. The motor 8 is disposed such that the output shaft 8A (rotation shaft) of the motor 8 intersects the longer axis of the tool bit 4 (i.e., the Z axis). In other words, the output shaft 8A extends in the vertical direction of the hammer drill 2.

Figure 2:
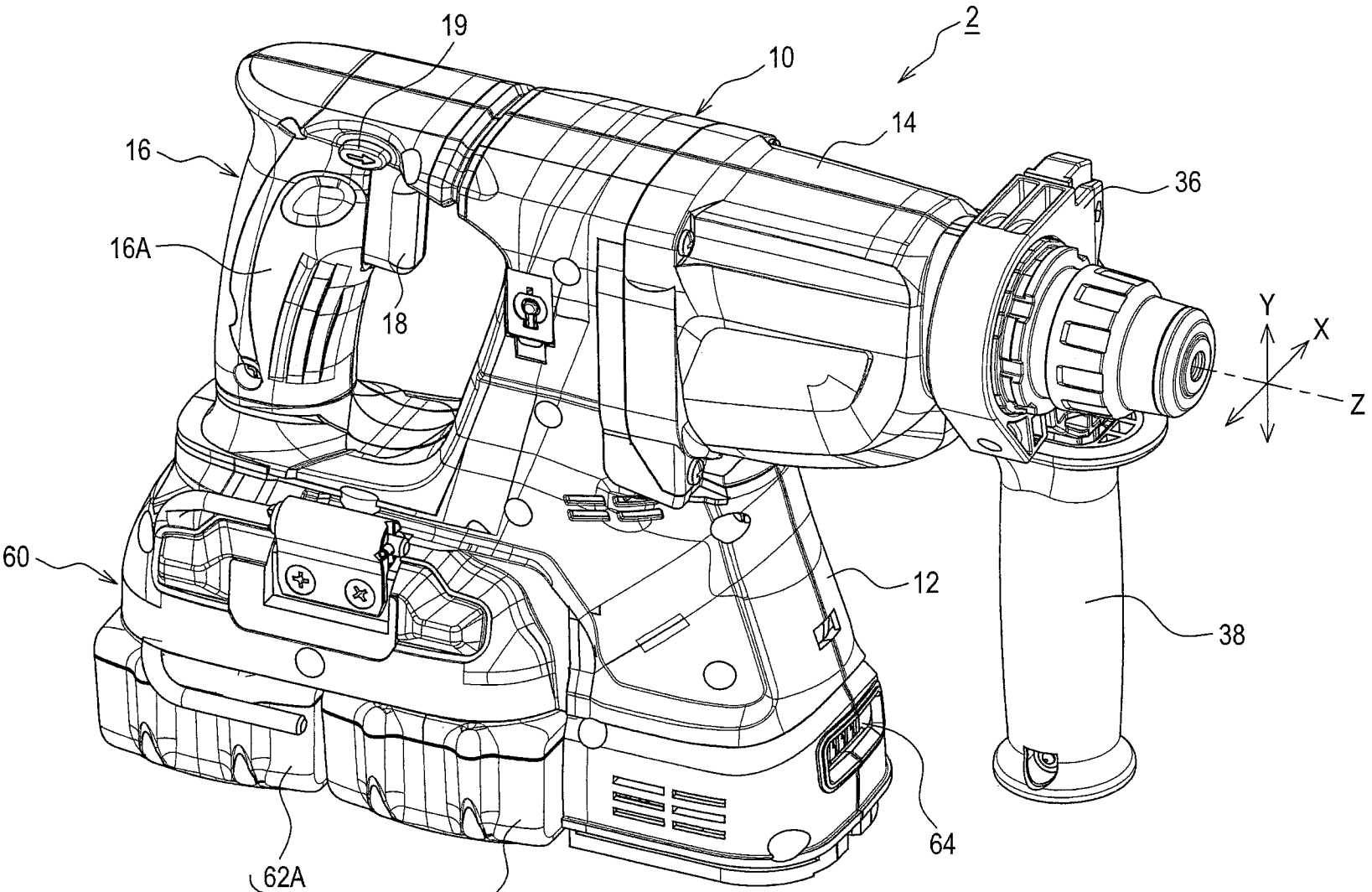
FIG. 2 is a perspective view of the external view of the hammer drill.

As shown in FIG. 2, in the gear housing 14, a holder grip 38 is attached to the outer area of the tip region from which the tool bit 4 protrudes, through an annular fixer member 36. Like the hand grip 16, the holder grip 38 is configured to be gripped by the user. To be specific, the user grips the hand grip 16 with one hand and the holder grip 38 with the other hand, thereby securely holding the hammer drill 2.

Figure 3:
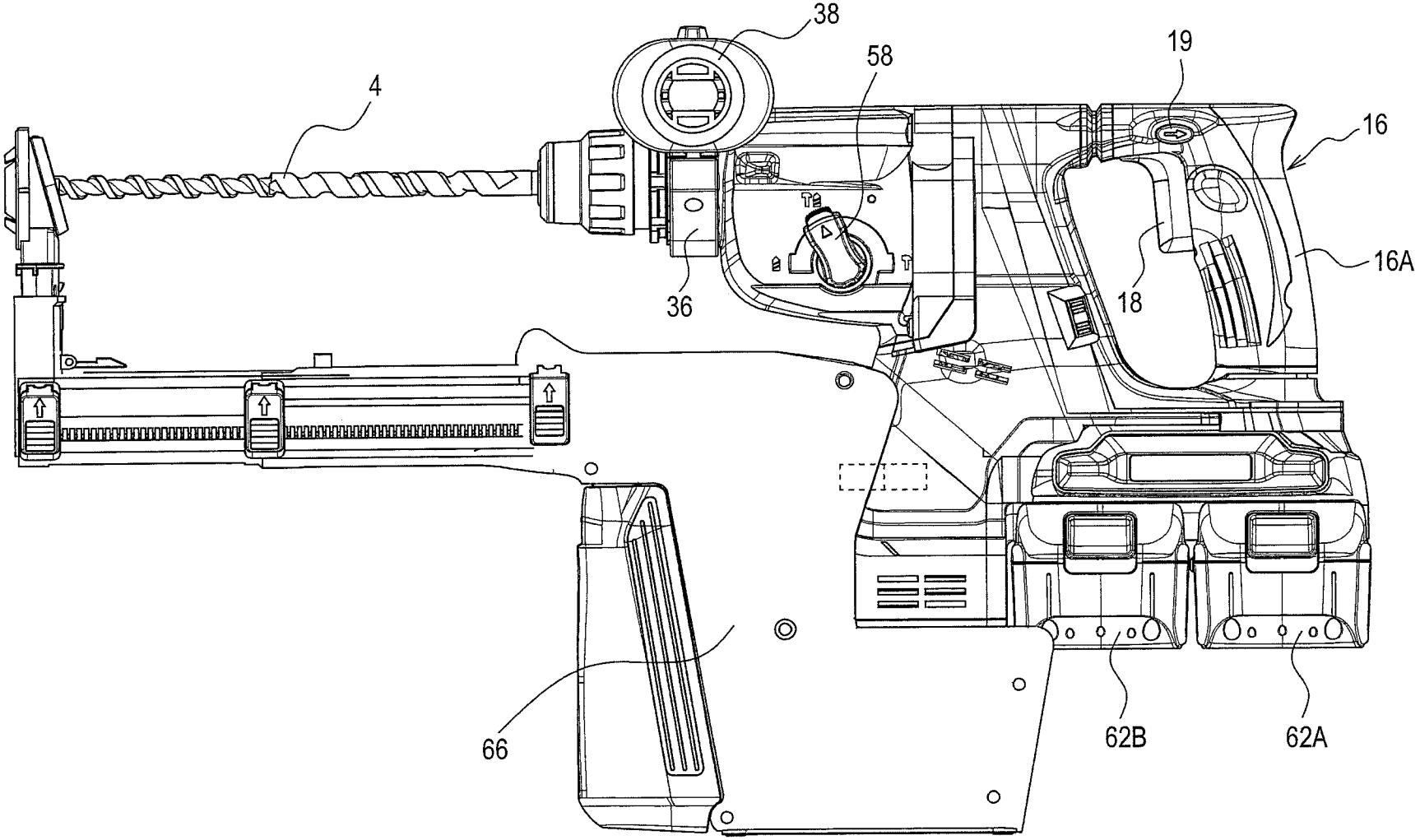
FIG. 3 is a side view of the hammer drill with a dust collector device attached thereto.

As shown in FIG. 3, a dust collector device 66 is mounted to the front side of the motor housing 12. To mount the dust collector device 66, as shown in FIGS. 1 and 2, a depressed portion is provided on the lower and front portion of the motor housing 12 (i.e., the lower and front portion of the motor 8) for fixation of the dust collector device 66. A connector 64 for electrical connection to the dust collector device 66 is provided in the depressed portion.

Further, a twisted-motion detector 90 is accommodated in a lower portion of the motor housing 12 (i.e., in a lower portion of the motor 8). When the tool bit 4 is rotated for a drilling operation and the tool bit 4 fits in the work piece, the twisted-motion detector 90 detects twisting of the main body housing 10.

Battery packs 62A and 62B serving as the power source of the hammer drill 2 are provided on the back side of the container region of the twisted-motion detector 90. The battery packs 62A and 62B are detachably attached to a battery port 60 provided on the lower side of the motor housing 12.

The battery port 60 is higher than the lower end surface of the container region of the twisted-motion detector 90 (i.e., the bottom surface of the motor housing 12). The lower end surfaces of the battery packs 62A and 62B attached to the battery port 60 flush with the lower end surface of the container region of the twisted-motion detector 90.

A motor controller 70 is provided on the upper side of the battery port 60 in the motor housing 12. The motor controller 70 controls drive of the motor 8, receiving electric power from the battery packs 62A and 62B.

The rotation of the output shaft 8A of the motor 8 is converted to a linear motion by the motion converting mechanism 20 and then transmitted to the hammering element 30. The hammering element 30 generates impact force in the direction along the longer axis of the tool bit 4. The rotation of the output shaft 8A of the motor 8 is decelerated by the rotation transmitting mechanism 40 and transmitted also to the tool bit 4. In other words, the motor 8 rotatively drives the tool bit 4 about the longer axis. The motor 8 is driven in accordance with the pulling operation on a trigger 18 disposed on the hand grip 16.

As shown in FIG. 1, the motion converting mechanism 20 is disposed on the upper side of the output shaft 8A of the motor 8.

The motion converting mechanism 20 includes a countershaft 21, a rotating object 23, a swing member 25, a piston 27, and a cylinder 29. The countershaft 21 is disposed to intersect the output shaft 8A and is rotatively driven by the output shaft 8A. The rotating object 23 is attached to the countershaft 21. The swing member 25 is swung in the back and forth direction of the hammer drill 2 with the rotation of the countershaft 21 (the rotating object 23). The piston 27 is a bottomed cylindrical member slidably housing a striker 32 which will be described later. The piston 27 reciprocates in the back and forth direction of the hammer drill 2 with the swing of the swing member 25.

The cylinder 29 is integrated with the tool holder 6. The cylinder 29 houses the piston 27 and defines a back region of the tool holder 6.

As shown in FIG. 1, the hammering element 30 is disposed on the front side of the motion converting mechanism 20 and on the back side of the tool holder 6. The hammering element 30 includes the above-described striker 32 and an impact bolt 34. The striker 32 serves as a hammer and strikes the impact bolt 34 disposed on the front side of the striker 32.

The space in the piston 27 on the back side of the striker 32 defines an air chamber 27*a*, and the air chamber 27*a* serves as an air spring. Accordingly, the swing of the swing member 25 in the back and forth direction of the hammer drill 2 causes the piston 27 to reciprocate in the back and forth direction, thereby driving the striker 32.

In other words, the forward motion of the piston 27 causes the striker 32 to move forward by the act of the air spring and strike the impact bolt 34. Accordingly, the impact bolt 34 is moved forward and strikes the tool bit 4. Consequently, the tool bit 4 hammers the work piece.

In addition, the backward motion of the piston 27 moves the striker 32 backward and thereby makes the pressure of the air in the air chamber 27*a* positive with respect to atmospheric pressure. Further, reaction force generated when the tool bit 4 hammers the work piece also moves the striker 32 and the impact bolt 34 backward.

This causes the striker 32 and the impact bolt 34 to reciprocate in the back and forth direction of the hammer drill 2. The striker 32 and the impact bolt 34, which are driven by the act of the air spring of the air chamber 27*a*, move in the back and forth direction, following the motion of the piston 27 in the back and forth direction.

As shown in FIG. 1, the rotation transmitting mechanism 40 is disposed on the front side of the motion converting mechanism 20 and on the lower side of the hammering element 30. The rotation transmitting mechanism 40 includes a gear deceleration mechanism. The gear deceleration mechanism includes a plurality of gears including a first gear 42 rotating with the countershaft 21 and a second gear 44 to be engaged with the first gear 42.

The second gear 44 is integrated with the tool holder 6 (specifically, the cylinder 29) and transmits the rotation of the first gear 42 to the tool holder 6. Thus, the tool bit 4 held by the tool holder 6 is rotated. The rotation of the output shaft 8A of the motor 8 is decelerated by, in addition to the rotation transmitting mechanism 40, a first bevel gear that is provided at the front tip of the output shaft 8A and a second bevel gear that is provided at the back tip of the countershaft 21 and engages with the first bevel gear.

The hammer drill 2 of this embodiment has three drive modes including a hammer mode, a hammer drill mode, and a drill mode.

In the hammer mode, the tool bit 4 performs a hammering operation along the longer axis direction, thereby hammering the work piece. In the hammer drill mode, the tool bit 4 performs a rotation operation about the longer axis in addition to a hammering operation, so that the work piece is drilled while being hammered by the tool bit 4. In the drill mode, the tool bit 4 does not perform a hammering operation and only performs a rotation operation, so that the work piece is drilled.

The drive mode is switched by the mode switching mechanism 50. The mode switching mechanism 50 includes rotation transmitting members 52 and 54 shown in FIG. 1 and a switching dial 58 shown in FIG. 3.

The rotation transmitting members 52 and 54 are generally cylindrical members and movable along the countershaft 21. The rotation transmitting members 52 and 54 are spline-engaged with the countershaft 21 and rotate in cooperation with the countershaft 21.

The rotation transmitting member 52 moving toward the back side of the countershaft 21 is engaged with an engagement groove on the front of the rotating object 23 and transmits the rotation of the motor 8 to the rotating object 23. Consequently, the drive mode of the hammer drill 2 is set to the hammer mode or the hammer drill mode.

The rotation transmitting member 54 moving toward the front side of the countershaft 21 is engaged with the first gear 42 and transmits the rotation of the motor 8 to the first gear 42. Consequently, the drive mode of the hammer drill 2 is set to the hammer drill mode or the drill mode.

The switching dial 58 turned by the user displaces the rotation transmitting members 52 and 54 on the countershaft 21. The switching dial 58 is turned and set to any of the three positions shown in FIG. 3, thereby setting the drive mode of the hammer drill 2 to any of the modes: the hammer mode, the hammer drill mode, and the drill mode.

The structures of the motor controller 70 and the twisted-motion detector 90 will now be described with reference to FIG. 4.

The twisted-motion detector 90 includes an acceleration sensor 92 and an acceleration detecting circuit 94. The acceleration sensor 92 and the acceleration detecting circuit 94 are mounted on a common circuit board and contained in a common case.

The acceleration sensor 92 detects accelerations (more specifically, values of accelerations) in the directions along three axes (i.e., the X axis, the Y axis, and the Z axis).

The acceleration detecting circuit 94 subjects detection signals from the acceleration sensor 92 to process to detect twisting of the main body housing 10.

To be specific, the acceleration detecting circuit 94 includes a micro controller unit (MCU) including a CPU, a ROM, and a RAM. The acceleration detecting circuit 94 executes a twisted-motion detecting process, which will be described later, to detect the rotation of the main body housing 10 about the Z axis (i.e., the longer axis of the tool bit 4) over a predetermined angle, in accordance with detection signals (specifically, an output based on acceleration in the direction of the X axis) from the acceleration sensor 92.

The acceleration detecting circuit 94 further executes an acceleration load detecting process to detect, using the acceleration sensor 92, vibrations (more specifically, magnitude of vibrations) that occur in the main body housing 10 in the directions of the three axes due to a hammering operation of the tool bit 4. In this acceleration load detecting process, the acceleration detecting circuit 94 detects imposition of a load on the tool bit 4 if a vibration in the main body housing 10 (i.e., acceleration) exceeds a threshold.

The motor controller 70 includes a drive circuit 72 and a control circuit 80. The drive circuit 72 and the control circuit 80 are mounted on another common circuit board together with various detection circuits, which will be described later, and contained in another common case.

The drive circuit 72 includes switching devices Q1 to Q6 and is configured to receive electric power from a battery pack 62 (specifically, series-connected battery packs 62A and 62B) and feed current to a plurality of phase windings in the motor 8 (which is, specifically, a three-phase brushless motor). The switching devices Q1 to Q6 in this embodiment are FETs but not limited to FETs in the present disclosure. The switching devices Q1 to Q6 in another embodiment may be switching devices other than FETs.

The switching devices Q1 to Q3 are each provided as a so-called high side switch between a power source line and one corresponding terminal selected from the terminals U, V, and W of the motor 8. The power source line is coupled to the positive terminal of the battery pack 62.

The switching devices Q4 to Q6 are each provided as a so-called low side switch between a ground line and one corresponding terminal selected from the terminals U, V, and W of the motor 8. The ground line is coupled to the negative terminal of the battery pack 62.

A capacitor C1 for restraining fluctuations in battery voltage is provided in a power supply path from the battery pack 62 to the drive circuit 72.

Like the acceleration detecting circuit 94, the control circuit 80 includes an MCU including a CPU, a ROM, and a RAM. The control circuit 80 feeds current to a plurality of phase windings in the motor 8 by turning on and off the switching devices Q1 to Q6 in the drive circuit 72, and rotates the motor 8.

To be specific, the control circuit 80 sets the command rotational speed and rotation direction of the motor 8 in accordance with commands from a trigger switch 18*a*, a speed change commander 18*b*, an upper-limit speed setter 96, and a rotation direction setter 19, and controls drive of the motor 8.

The trigger switch 18*a* is turned on by pulling the trigger 18 and is configured to input a drive command for the motor 8 to the control circuit 80. The speed change commander 18*b* is configured to generate a signal depending on the amount of pulling operation of the trigger 18 (i.e., the operation rate) and vary the command rotational speed depending on this amount of operation.

The upper-limit speed setter 96 includes a not-shown dial. The operational position of the dial is switched by the user of the hammer drill 2 stage by stage. The upper-limit speed setter 96 is configured to set the upper limit of rotational speed of the motor 8 depending on the operational position of the dial.

To be specific, the upper-limit speed setter 96 is configured to be able to set the upper limit of the rotational speed of the motor 8 between a rotational speed higher than a no-load rotational speed under soft no load control, which will be described later, and a rotational speed lower than the no-load rotational speed.

The rotation direction setter 19 is configured to set the rotation direction of the motor 8 to a normal or opposite direction through the operation by the user, and is provided, in this embodiment, on the upper side of the trigger 18 as shown in FIGS. 2 and 3. Rotating the motor 8 in a normal direction enables drilling of the work piece.

The control circuit 80 sets the command rotational speed of the motor 8 in accordance with a signal from the speed change commander 18*b* and an upper limit rotational speed set through the upper-limit speed setter 96. In particular, the control circuit 80 sets a command rotational speed dependent on the amount of the operation (the operation rate) of the trigger 18 such that the rotational speed of the motor 8 reaches the upper limit rotational speed set by the upper-limit speed setter 96, when the trigger 18 is pulled to a maximum extent.

The control circuit 80 sets a drive duty ratio among the switching devices Q1 to Q6 rotatively drives the motor 8 by transmitting a control signal based on the drive duty ratio to the drive circuit 72, in accordance with the set command rotational speed and rotation direction.

An LED 84 serving as a lighting (hereinafter referred to as "lighting LED 84") is provided in the front side of the motor housing 12. When the trigger switch 18*a* is turned on, the control circuit 80 turns on the lighting LED 84 to illuminate a portion of the work piece to be processed with the tool bit 4.

Rotational position sensors 81 are provided to the motor 8. The rotational position sensors 81 detect the rotational speed and rotational position of the motor 8 (to be specific, the rotational position of the rotor of the motor 8), and transmit detection signals to the motor controller 70. The motor controller 70 includes a rotational position detection circuit 82. The rotational position detection circuit 82 detects the rotational position needed for setting the timing of energization of each phase winding in the motor 8, in accordance with detection signals from the rotational position sensors 81.

The motor controller 70 further includes a voltage detection circuit 78, a current detection circuit 74, and a temperature detection circuit 76.

The voltage detection circuit 78 detects the value of a battery voltage supplied from the battery pack 62. The current detection circuit 74 detects the value of a current flowing through the motor 8 via a resistor R1 provided in a current path to the motor 8. The current detection circuit 74 corresponds to one example of the current detector in the present disclosure.

The temperature detection circuit 76 detects the temperature of the motor controller 70.

The control circuit 80 receives detection signals from the voltage detection circuit 78, the current detection circuit 74, the temperature detection circuit 76, and the rotational position detection circuit 82, and detection signals from the twisted-motion detector 90.

The control circuit 80 restricts the rotational speed of the motor 8 that is being driven or stops the drive of the motor 8, in accordance with detection signals from the voltage detection circuit 78, the current detection circuit 74, the temperature detection circuit 76, and the rotational position detection circuit 82.

The motor controller 70 includes a not-shown regulator for receiving power from the battery pack 62 and generating a constant power source voltage Vcc.

The power source voltage Vcc generated by the regulator is supplied to the MCU of the control circuit 80 and the acceleration detecting circuit 94 of the twisted-motion detector 90. In addition, upon detection of twisting of the main body housing 10 from the acceleration in the direction of the X axis, the acceleration detecting circuit 94 transmits an error signal to the control circuit 80.

This error signal is transmitted for stopping drive of the motor 8. When the main body housing 10 is not twisted, the acceleration detecting circuit 94 transmits a no-error signal to the control circuit 80.

Upon detection of imposition of a load to the tool bit 4 from vibration (i.e., acceleration) of the main body housing 10, the acceleration detecting circuit 94 transmits a load signal to the control circuit 80. The load signal indicates the fact that the tool bit 4 is in a load state. When the acceleration detecting circuit 94 does not detect imposition of a load to the tool bit 4, the acceleration detecting circuit 94 transmits a no-load signal to the control circuit 80. The no-load signal indicates the fact that the tool bit 4 is in a no-load state.

The dust collector device 66 mounted on the front side of the motor housing 12 collects, by suction, dust particles that occur from the work piece upon chipping and drilling.

Figure 4:
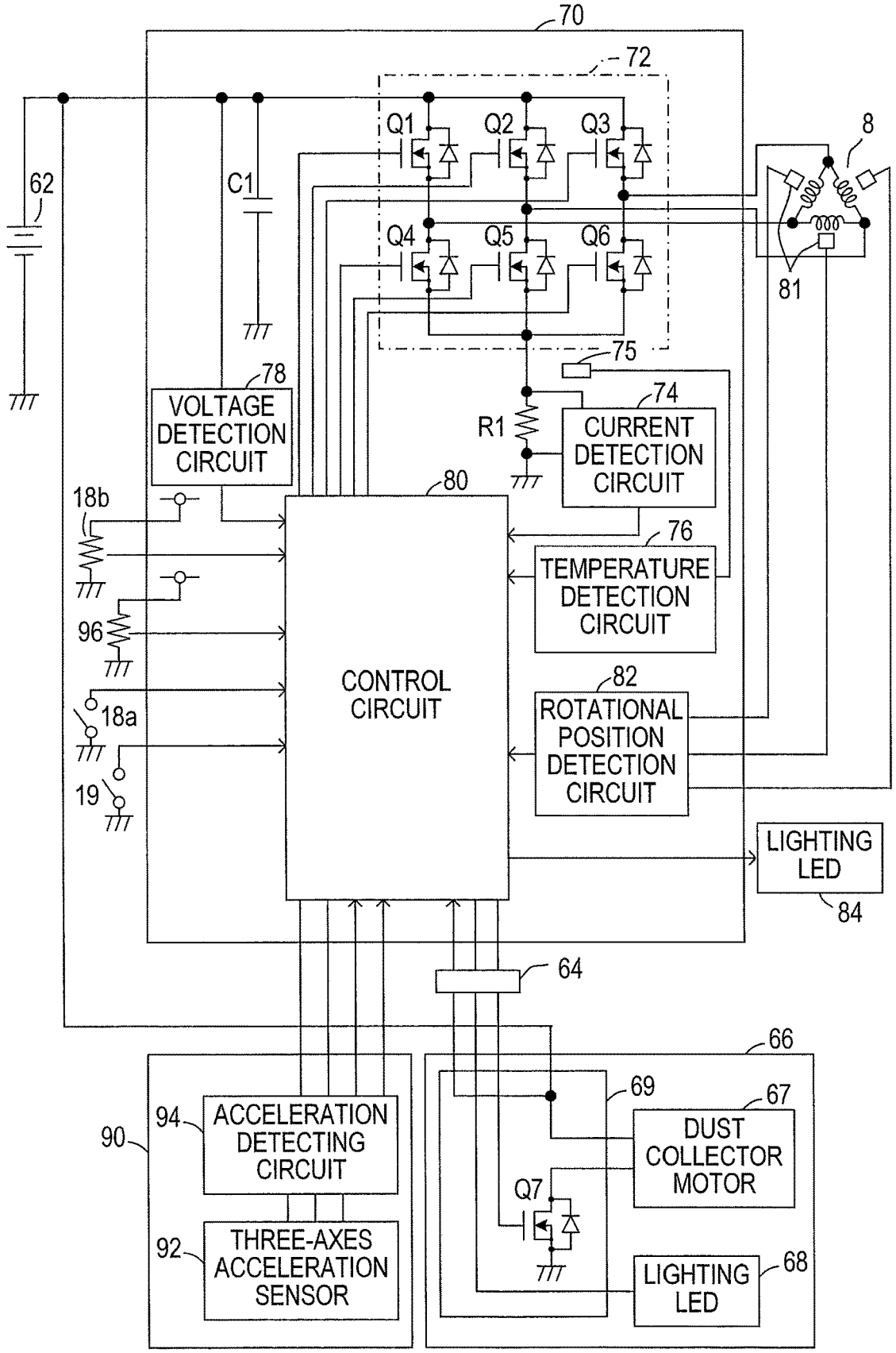
FIG. 4 is a block diagram showing an electrical configuration of a drive system of the hammer drill.

As shown in FIG. 4, the dust collector device 66 includes a dust collector motor 67 and a circuit board 69. The dust collector motor 67 is driven by the circuit board 69. The dust collector device 66 includes a lighting LED 68 that has a function of illuminating a portion of the work piece to be processed, instead of the lighting LED 84 provided to the motor housing 12. This is because the lighting LED 84 is covered when the dust collector device 66 is mounted to the motor housing 12.

When the dust collector device 66 is mounted to the motor housing 12, drive current is fed from the battery pack 62 to the dust collector motor 67 through the current path on the circuit board 69.

When the dust collector device 66 is mounted to the motor housing 12, the circuit board 69 is coupled to the control circuit 80 through the connector 64. The circuit board 69 includes the switching device Q7 and turns on and off the switching device Q7 to open and close the current path to the dust collector motor 67. The lighting LED 68 can be turned on by a drive signal from the control circuit 80.

Control process performed in the control circuit 80 will now be explained with the flow charts of FIGS. 5 to 11. It should be noted that this control process is implemented when the CPU in the control circuit 80 executes a program stored in the ROM which is a nonvolatile memory.

Figure 5:
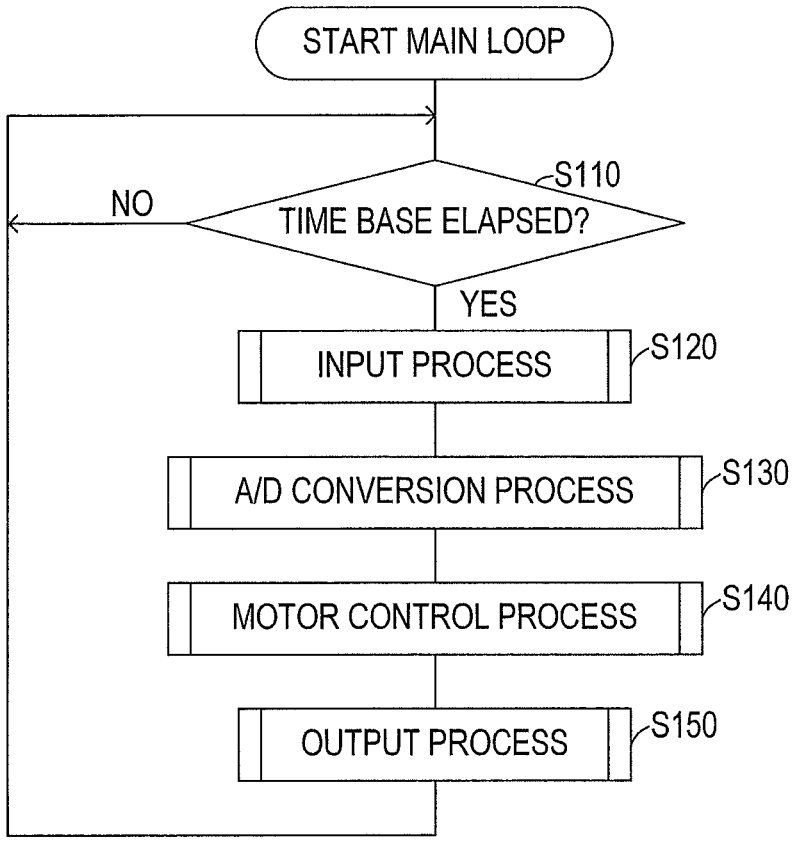
FIG. 5 is a flow chart of control process executed in a control circuit in a motor controller.

As shown in FIG. 5, in this control process, whether a given time base has elapsed is first determined in S110 (S represents Step) and a waiting time lasts until the elapse of the time base from the execution of the previous process from S120. This time base corresponds to the cycle for controlling drive of the motor.

If it is determined that the time base has elapsed in S110, input process in S120, A/D conversion process in S130, motor control process in S140, and output process in S150 are sequentially executed and the process goes to S110 again. In other words, in this control process, the CPU in the control circuit 80 executes a series of process in S120 to S150 each elapse of the time base, that is, in a cyclical fashion.

Figure 6:
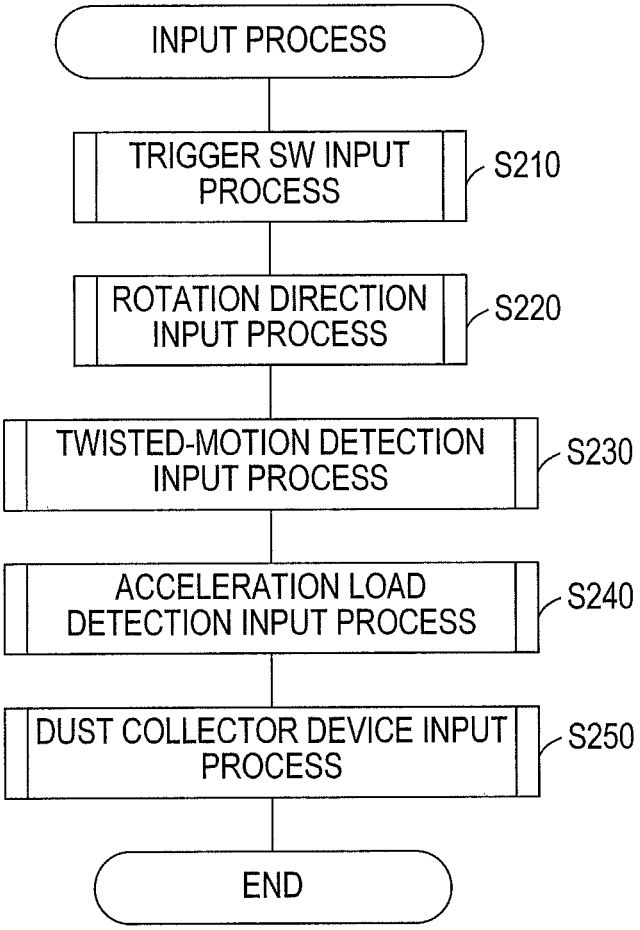
FIG. 6 is a flow chart showing details of an input process shown in FIG. 5.

Here, in input process in S120, as shown in FIG. 6, trigger switch (trigger SW) input process is first executed in S210 for retrieving the operation state of the trigger 18 from the trigger switch 18*a*. In the following S220, rotation direction input process is executed for retrieving the direction of the rotation of the motor 8 from the rotation direction setter 19.

In the following S230, a twisted-motion detection input process is executed for retrieving the results of detection (an error signal or no-error signal) of a twisted-motion from the twisted-motion detector 90. In the following S240, acceleration load detection input process is executed for retrieving the results of detection of an acceleration load from the twisted-motion detector 90 (a load signal or no-load signal).

Finally, in S250, dust collector device input process is executed for detecting the value of the battery voltage through the connector 64 of the dust collector device 66, and the input process in S120 is terminated. It should be noted that the dust collector device input process in S250 detects the value of the battery voltage in order to determine whether the dust collector device 66 is mounted to the motor housing 12.

In the following A/D conversion process in S130, detection signals (voltage signals) related to the amount of pulling operation of the trigger 18 and upper-limit speed, or a voltage value, a current value, a temperature, and the like are retrieved, through A/D conversion, from the speed change commander 18*b*, the upper-limit speed setter 96, the voltage detection circuit 78, the current detection circuit 74, the temperature detection circuit 76 and the like.

Figure 7:
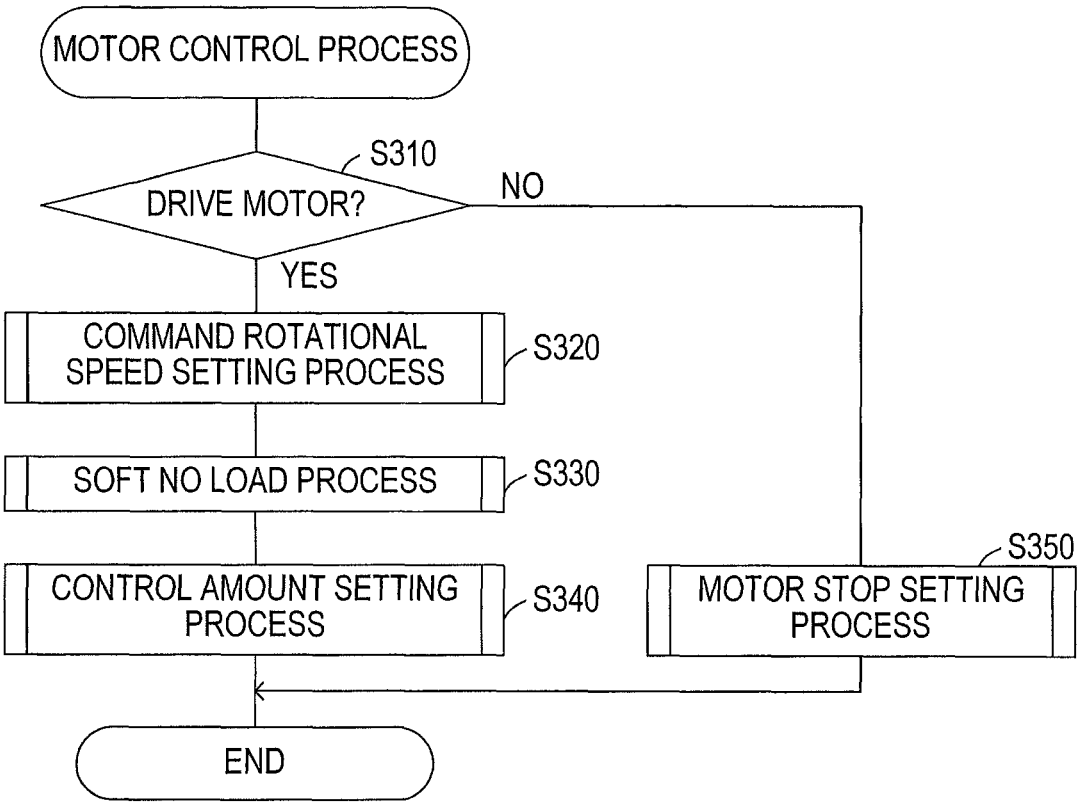
FIG. 7 is a flow chart showing details of a motor control process shown in FIG. 5.

As shown in FIG. 7, in motor control process in S140, whether the motor 8 should be driven based on motor drive conditions is first determined in S310.

In this embodiment, the motor drive conditions are satisfied when the trigger switch 18*a* is in the on state, the voltage value, the current value, and the temperature retrieved in S130 are normal, and no twisted-motion of the main body housing 10 is detected by the twisted-motion detector 90 (no-error signal input).

When the motor drive conditions are satisfied and if it is determined that the motor 8 should be driven in S310, the process proceeds to S320 and command rotational speed setting process is executed. In this command rotational speed setting process, the command rotational speed is set in accordance with a signal from the speed change commander 18*b* and an upper limit rotational speed set through the upper-limit speed setter 96.

In the following S330, soft no load process is executed. In soft no load process, when the tool bit 4 is in the no load state, the command rotational speed of the motor 8 is limited below a predetermined no-load rotational speed Nth.

In the following S340, control amount setting process is executed. In this control amount setting process, the drive duty ratio for the motor 8 is set according to the command rotational speed set in S320 or limited below the predetermined no-load rotational speed Nth in S330. Upon completion of this control amount setting process, the motor control process is terminated.

It should be noted that in S340, the drive duty ratio is set such that the drive duty ratio does not rapidly change in accordance with a change of the command rotational speed from the rotational speed set by a trigger operation or the like to the no-load rotational speed or toward the side opposite to this.

In other words, in S340, the rate of change in the drive duty ratio (i.e., the gradient of change) is limited so that the rotational speed of the motor 8 can gradually change. This is for restraining a rapid change in the rotational speed of the motor 8 when the tool bit 4 is made in contact with the work piece or separated from the work piece.

When the motor drive conditions are not satisfied and if it is determined that the motor 8 should not be driven in S310, the process proceeds to S350 and a motor stop setting process for setting a stop of drive of the motor 8 is executed and the motor control process is terminated.

Figure 8:
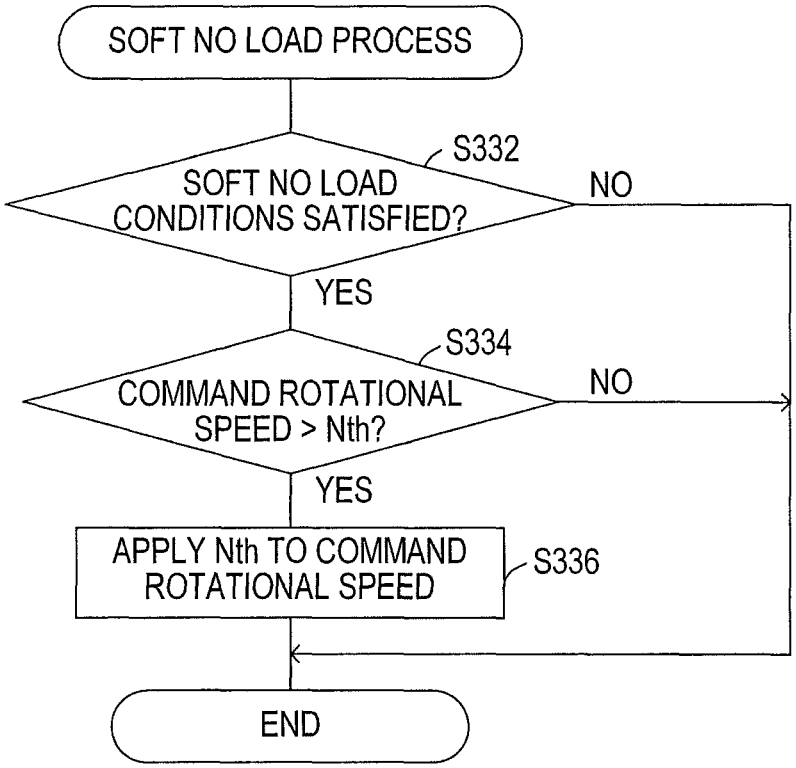
FIG. 8 is a flow chart showing details of a soft no load process shown in FIG. 7.

As shown in FIG. 8, in soft no load process in the following S330, whether soft no load control execution conditions (soft no load conditions) are satisfied is first determined in S332. Under soft no load control, the command rotational speed of the motor 8 is limited at or below the no-load rotational speed Nth.

Figure 9:
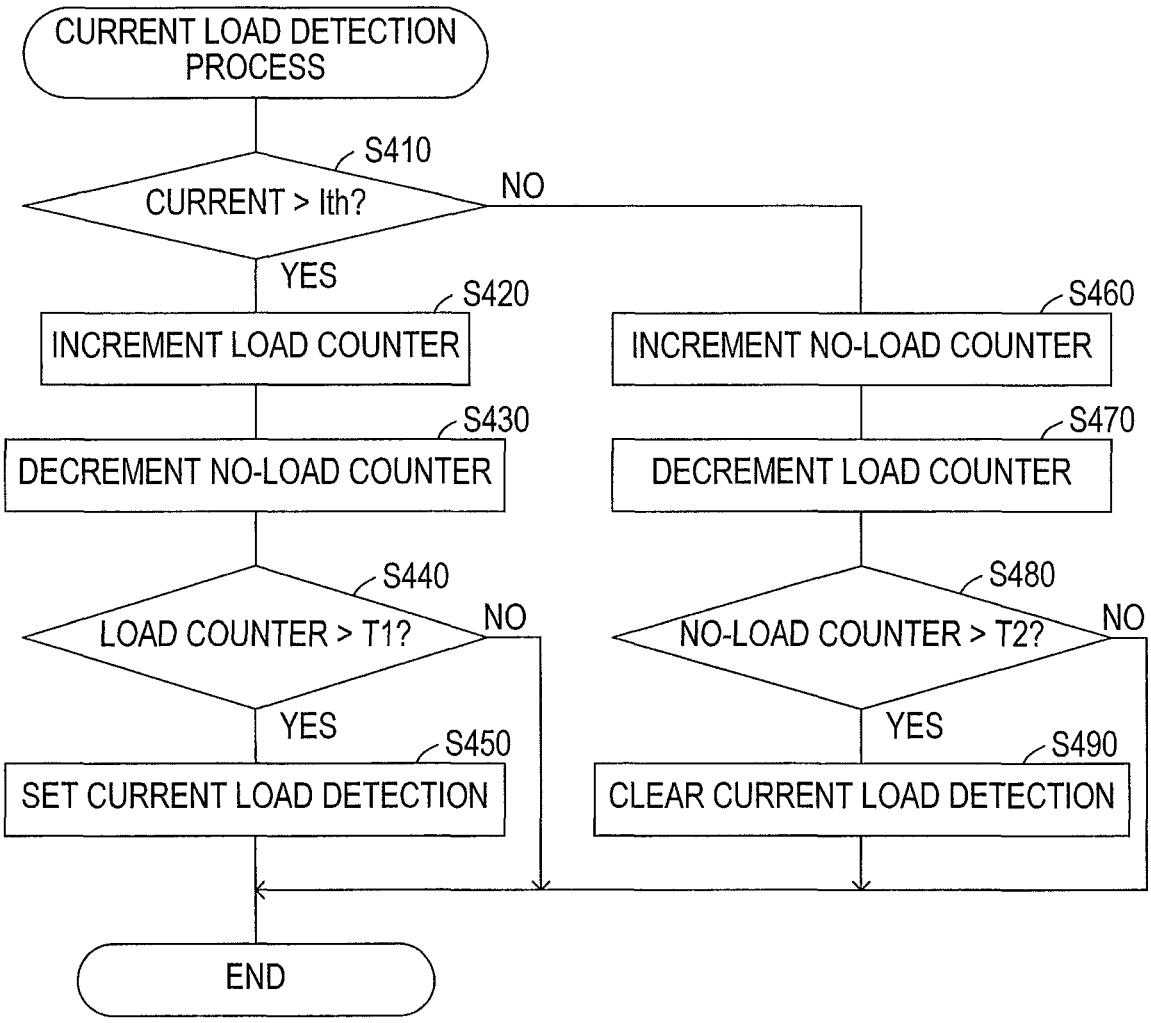
FIG. 9 is a flow chart of a current load detection process executed in an A/D conversion process shown in FIG. 5.

In this embodiment, soft no load conditions are satisfied in a current load detection process shown in FIG. 9 and in the acceleration detecting circuit 94 in the twisted-motion detector 90, when the tool bit 4 is determined to be in the no-load state and the dust collector device 66 is not mounted to the hammer drill 2.

If it is determined that the soft no load conditions are satisfied in S332, the process proceeds to S334 and whether the command rotational speed exceeds the no-load rotational speed Nth (e.g., 11000 rpm) is determined. This no-load rotational speed Nth corresponds to the upper limit rotational speed of soft no load control.

If the command rotational speed is determined to exceed the no-load rotational speed Nth in S334, the process proceeds to S336 in which the no-load rotational speed Nth is applied to the command rotational speed, and the soft no load process is terminated.

If it is determined that the soft no load conditions are not satisfied in S332 or that the command rotational speed does not exceed the no-load rotational speed Nth in S334, the soft no load process is immediately terminated.

To summarize, in the soft no load process, the command rotational speed is limited at or below the no-load rotational speed Nth if the tool bit 4 is determined to be in the no-load state in both the current load detection process in FIG. 9 and the acceleration detecting circuit 94, and when the dust collector device 66 is not mounted to the hammer drill 2.

In the A/D conversion process in S130, the current load detection process in FIG. 9 is executed for determining whether the tool bit 4 is in the no-load state in accordance with the current value retrieved from the current detection circuit 74.

In this current load detection process, first, in S410, whether the value retrieved through A/D conversion (detect current value) exceeds a current threshold Ith is determined. This current threshold Ith is a value predetermined to determine whether the tool bit 4 is in the load state.

If the detected current value exceeds the current threshold Ith, a load counter for load determination is incremented (+1) in S420, a no-load counter for no-load determination is decremented (−1) in S430, and the process proceeds to S440.

In S440, whether the value of the load counter exceeds a load determination value T1 is determined. The load determination value T1 is a value predetermined to determine whether the tool bit 4 is in the load state. If the value of the load counter exceeds the load determination value T1, the process proceeds to S450 and a current load detecting flag is set, and the current load detection process is then terminated.

If the value of the load counter does not exceed the load determination value T1, the current load detection process is immediately terminated. The current load detecting flag indicates that the tool bit 4 is in the load state, and is used to detect the fact (a current load) that the load state of the tool bit 4 is detected from a current value in S332 of the soft no load process.

If the detected current value is determined to be at or below the current threshold Ith in S410, the process proceeds to S460 in which the no-load counter is incremented (+1), and to the following S470 in which the load counter is decremented (−1).

In the following S480, whether the value of the no-load counter exceeds a no-load determination value T2 is determined. The no-load determination value T2 is a value predetermined to determine whether the tool bit 4 is in the no-load state. If the value of the no-load counter exceeds the no-load determination value T2, the process proceeds to S490 and the tool bit 4 is determined to be in the no-load state, so that the current load detecting flag is cleared and the current load detection process is terminated.

If the value of the no-load counter does not exceed the no-load determination value T2, the current load detection process is immediately terminated.

The load counter measures the time during which the detected current value exceeds the current threshold Ith. In the current load detection process, whether the time measured by the load counter has reached a predetermined time is determined by using the load determination value T1. The no-load counter measures the time during which the detected current value does not exceed the current threshold Ith. In the current load detection process, whether the time measured by the no-load counter has reached a predetermined time is determined by using the no-load determination value T2. The load determination value T1 corresponds to one example of the first threshold time in the present disclosure. The no-load determination value T2 corresponds to one example of the second threshold time in the present disclosure.

In this embodiment, the load determination value T1 is smaller than the no-load determination value T2 (i.e., the time measured by the load counter is shorter than the time measured by the no-load counter). This is for detecting the load state of the tool bit 4 more rapidly so that the rotational speed of the motor 8 can be set to a command rotational speed dependent on the amount of the operation of the trigger. The load determination value T1 is set to a value corresponding to, for example, 100 ms, and the no-load determination value T2 is set to a value corresponding to, for example, 500 ms.

Figure 10:
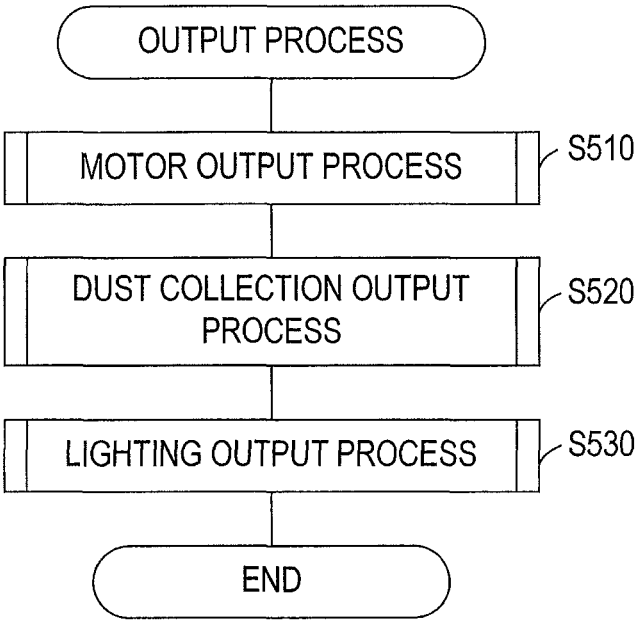
FIG. 10 is a flow chart showing details of an output process shown in FIG. 5.

As shown in FIG. 10, in output process in S150, motor output process is first executed in S510. In the motor output process, a control signal for driving the motor 8 at the command rotational speed, and a rotation direction signal for designating the rotation direction are transmitted to the drive circuit 72.

In the following S520, a dust collection output process is executed for transmitting a drive signal for the dust collector motor 67 to the dust collector device 66 mounted to the hammer drill 2. Subsequently, a lighting output process is executed for transmitting a drive signal to the lighting LED 84 to turn on the lighting LED 84 in S530, and the output process is terminated.

In S530, if the dust collector device 66 is mounted to the hammer drill 2, a drive signal is transmitted to the lighting LED 68, which is provided to the dust collector device 66, to turn on the lighting LED 68.

Figure 11:
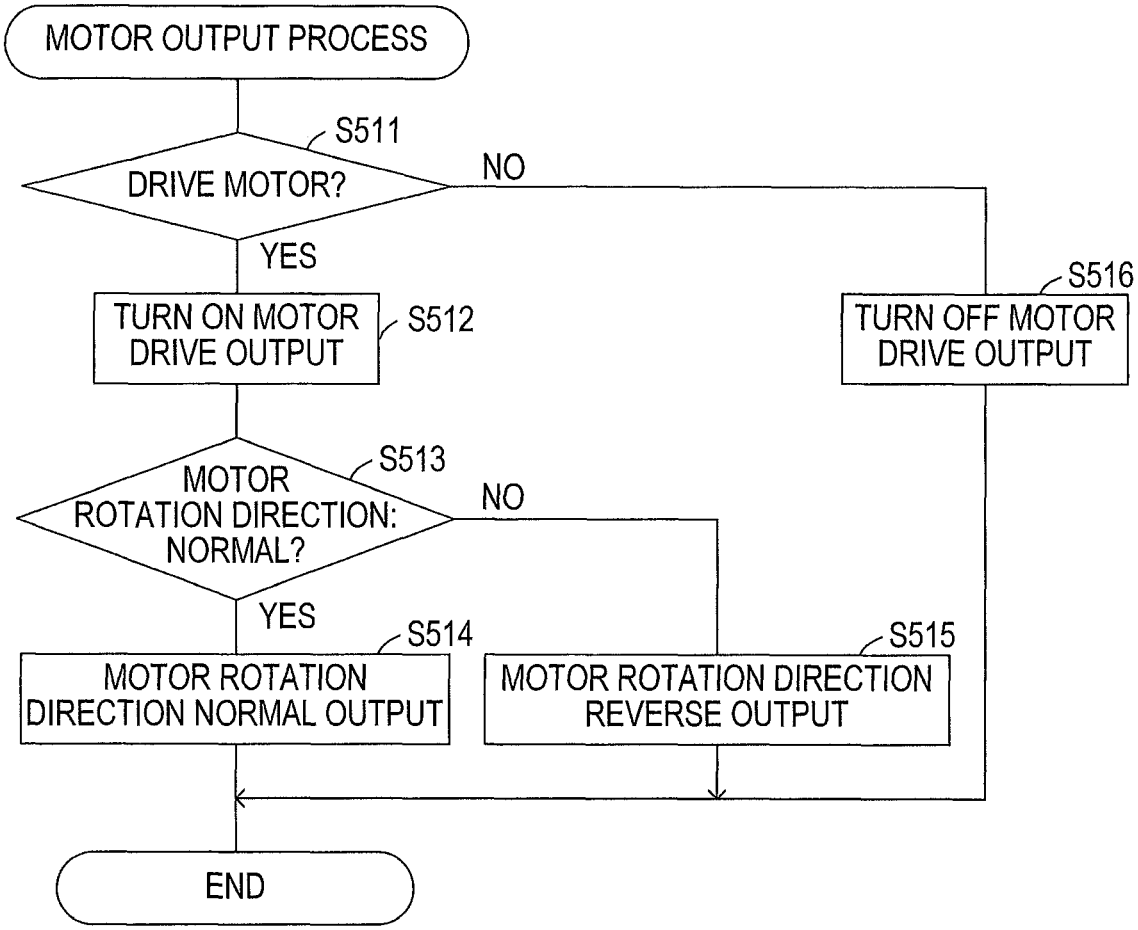
FIG. 11 is a flow chart showing details of a motor output process shown in FIG. 10.

As shown in FIG. 11, in motor output process in S510, whether the motor 8 should be driven is first determined in S511. Process in S511 is executed in a manner similar to that for S310 in the motor control process.

In other words, in S511, whether the motor drive conditions are satisfied is determined. These motor drive conditions are satisfied when the trigger switch 18*a* is in the on state, the voltage value, the current value, and the temperature retrieved in S130 are normal, and no twisted-motion of the main body housing 10 is detected by the twisted-motion detector 90 (no-error signal input).

When the motor drive conditions are satisfied and if it is determined that the motor 8 should be driven in S511, the process proceeds to S512 and transmission of a control signal to the drive circuit 72 is started.

In the following S513, whether the direction of the rotation of the motor 8 is the normal direction (forward direction) is determined. If the direction of the rotation of the motor 8 is the normal direction (forward direction), the process proceeds to S514 in which a rotation direction signal that designates the "forward direction" as the direction of the rotation of the motor 8 is transmitted to the drive circuit 72, and the motor output process is terminated.

If it is determined that the direction of the rotation of the motor 8 is not the normal direction in S513, the process proceeds to S515 in which a rotation direction signal that designates the "reverse direction" as the direction of the rotation of the motor 8 is transmitted to the drive circuit 72, and the motor output process is terminated.

When the motor drive conditions are not satisfied and if it is determined that the motor 8 should not be driven in S511, the process proceeds to S516 and transmission of a control signal to the drive circuit 72 is stopped.

Next, an acceleration load detecting process and twisted-motion detecting process executed in the acceleration detecting circuit 94 of the twisted-motion detector 90 will be explained with reference to the flow charts of FIGS. 12, 13A, and 13B.

Figure 12:
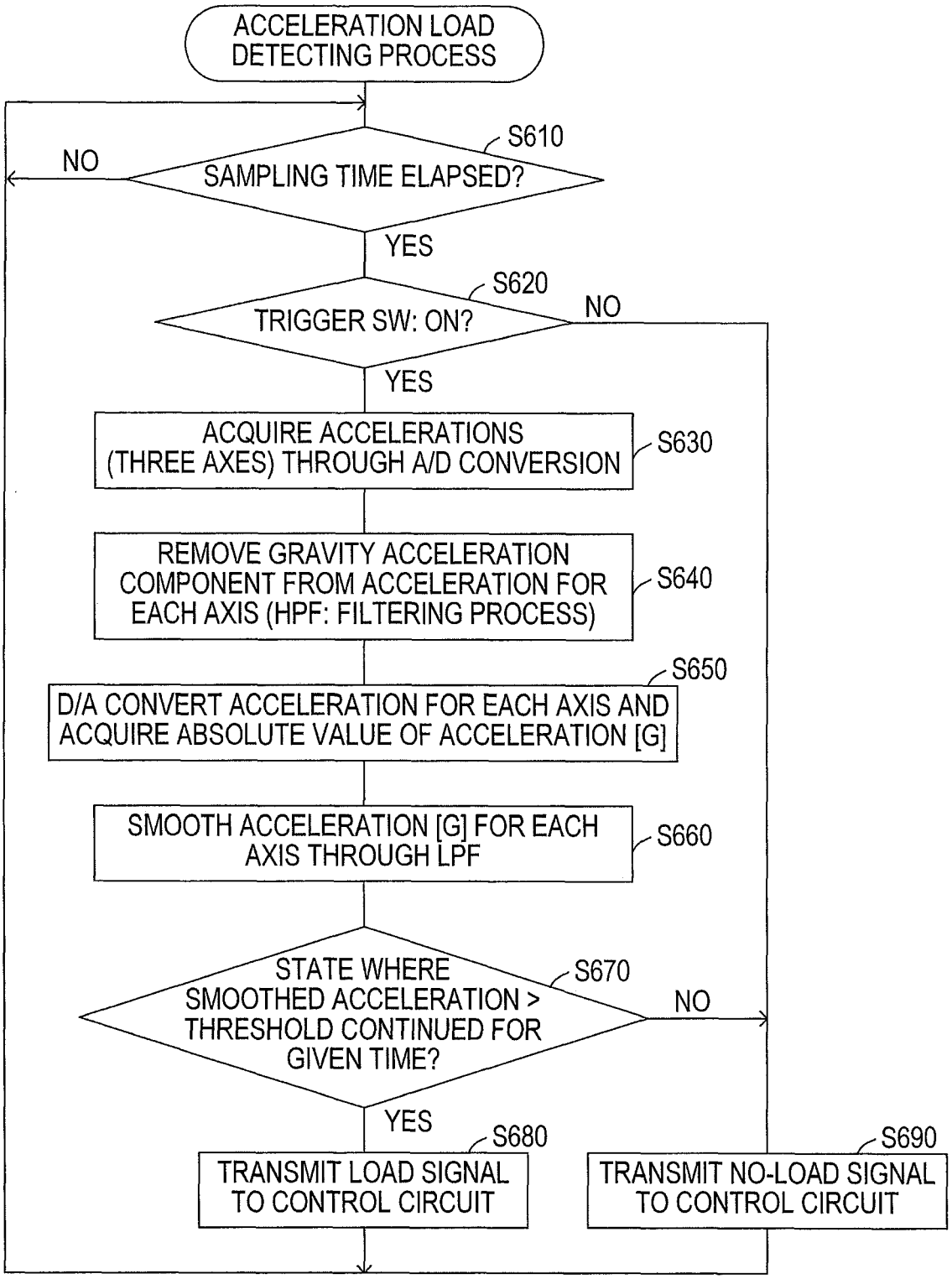
FIG. 12 is a flow chart of an acceleration load detecting process executed in an acceleration detecting circuit in a twisted-motion detector.

As shown in FIG. 12, for the acceleration load detecting process, in S610, whether a sampling time predetermined to judge load on the tool bit 4 has elapsed is determined. In other words, a waiting time lasts until the elapse of the given sampling time since the previous process executed S620.

If it is determined that the sampling time has elapsed in S610, the process proceeds to S620 in which whether the trigger switch 18*a* is in the on state (i.e., whether there is an input of a drive command of the motor 8 from the user) is determined.

If it is determined that the trigger switch 18*a* is in the on state in S620, the process proceeds to S630. Accelerations in the directions of the three axes (X, Y, and Z) is retrieved from the acceleration sensor 92 through A/D conversion in S630, and the retrieved acceleration data is subjected to a filtering process for removing gravity acceleration components from acceleration data related to the directions of the three axes in the following S640.

The filtering process in S640 functions as a high-pass filter (HPF) with a cut-off frequency of about 1 to 10 Hz for removing low-frequency components corresponding to gravity acceleration.

After the accelerations in the directions of the three axes is subjected to the filtering process in S640, the process proceeds to S650 in which the accelerations in the directions of the three axes after the filtering process is D/A converted and, for example, acceleration signals in the directions of the three axes after D/A conversion are subjected to full-wave rectification to obtain the absolute values of the respective accelerations [G] in the directions of the three axes.

The absolute values obtained in S650 are smoothed using a low-pass filter (LPF) to obtain the respective smoothed accelerations in the following S660, and the process proceeds to S670.

In S670, the respective smoothed accelerations are compared with a threshold predetermined to determine whether the tool bit 4 is in the load state, and whether the state where any of the smoothed accelerations exceeds the threshold has continued for over a given time is determined.

If it is determined that the state where any of the smoothed accelerations exceeds the threshold has continued for over the given time in S670, the tool bit 4 is determined to be in the load state and the process proceeds to S680. Subsequently, a load signal is transmitted to the control circuit 80 in S680, and the process proceeds to S610.

If it is determined that the state where any of the smoothed accelerations exceeds the threshold has not continued for over the given time in S670 or if it is determined that the trigger switch 18*a* is in the off state in S620, the process proceeds to S690.

In S690, a no-load signal is transmitted to the control circuit 80 to notify the control circuit 80 that the tool bit 4 is in the no-load state. The process then proceeds to S610.

Consequently, the control circuit 80 retrieves a load signal or no-load signal from the acceleration detecting circuit 94 and can therefore determine whether the load state (acceleration load) of the tool bit 4 is detected or whether the soft no load conditions are satisfied.

Figure 13A:
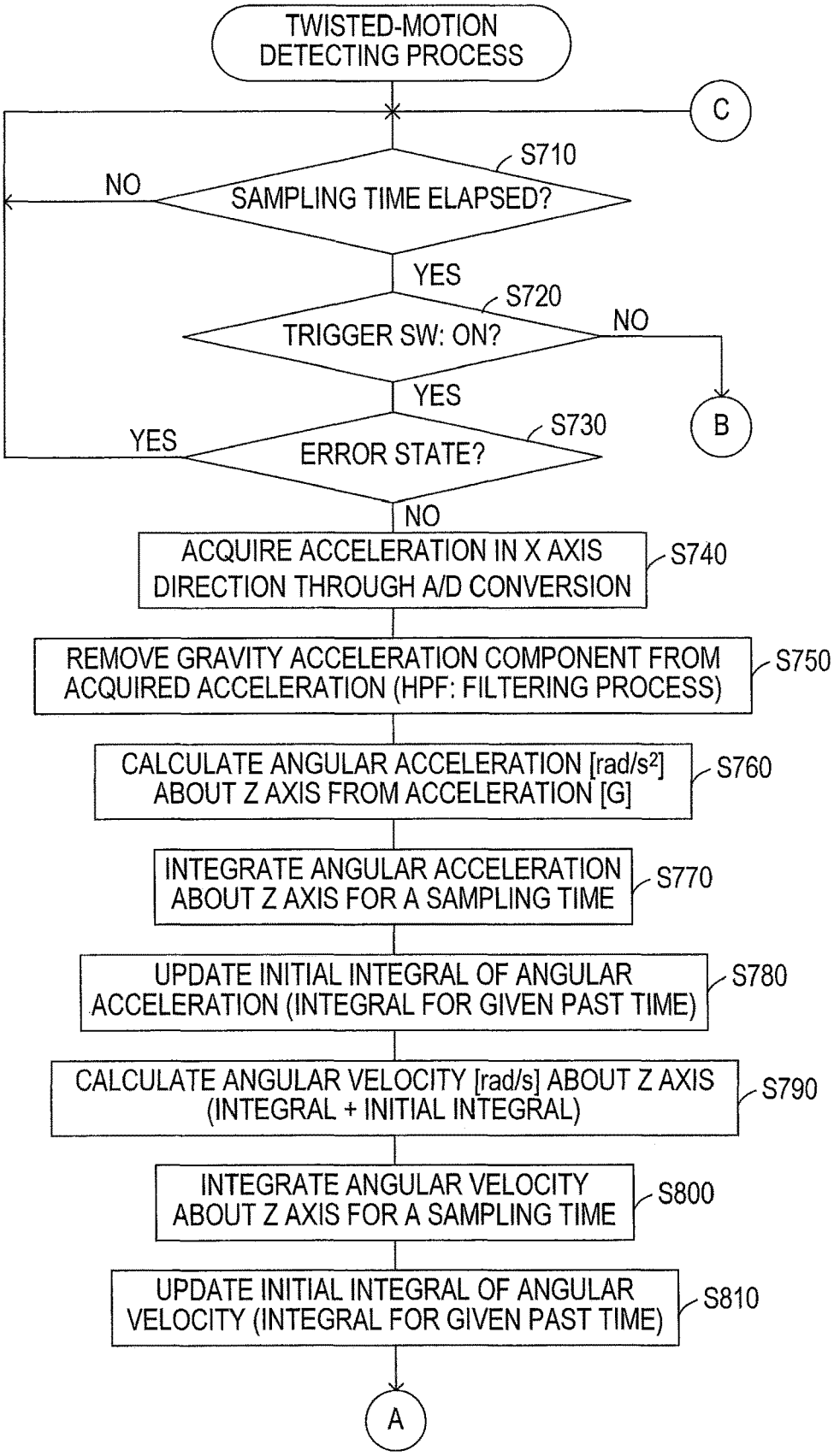
FIG. 13A is a flow chart of a part of a twisted-motion detecting process executed in the acceleration detecting circuit in the twisted-motion detector.
Figure 13B:
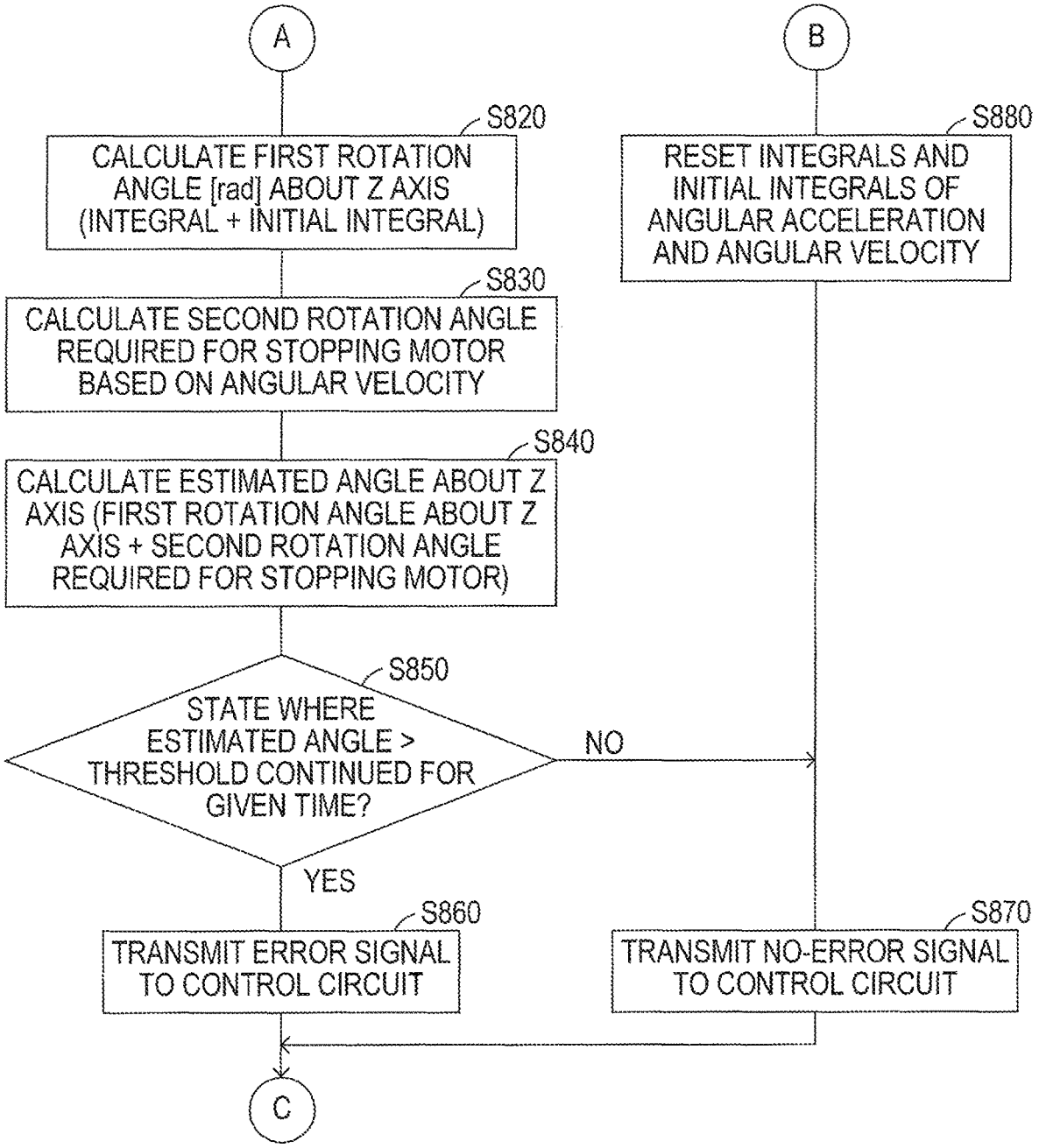
FIG. 13B is a flow chart showing the rest of the twisted-motion detecting process.

As shown in FIGS. 13A and 13B, in the twisted-motion detecting process, whether a sampling time predetermined to detect a twisted-motion has elapsed is determined in S710. In other words, a waiting time lasts until the elapse of the given sampling time since the previous process executed S720.

Subsequently, if it is determined that the sampling time has elapsed in S710, the process proceeds to S720 in which whether the trigger switch 18*a* is in the on state is determined. If the trigger switch 18*a* is in the on state, the process proceeds to S730.

In S730, twisting of the hammer drill 2 is detected in the twisted-motion detecting process and whether the error state is currently occurring is determined. If the error state is occurring, the process proceeds to S710. If the error state is not occurring, the process proceeds to S740.

In S740, the acceleration in the direction of the X axis is retrieved from the acceleration sensor 92 through A/D conversion. In the following S750, as in the above-described S640, gravity acceleration components are removed from the retrieved data of the acceleration in the direction of the X axis in a filtering process functioning as an HPF.

Subsequently, in S760, the angular acceleration [rad/s$^2$] about the Z axis is calculated from the acceleration [G] in the direction of the X axis after the filtering process by using the following expression. The process then proceeds to S770.

Expression: angular acceleration=acceleration $G$×9.8/distance $L$

In this expression, distance L is the distance between the acceleration sensor 92 and the Z axis.

In S770, the angular acceleration obtained in S760 is integrated for a sampling time. In the following S780, the initial integral of the angular acceleration is updated. This initial integral is the integral of the angular acceleration for a given past time. Since the angular acceleration has been additionally calculated in S760, the integral of the angular acceleration that has been sampled for a sampling time more than a given time ago is removed from the initial integral in S780.

In the following S790, the angular velocity [rad/s] about the Z axis is calculated by addition of the initial integral of the angular acceleration updated in S780 and the latest integral of the angular acceleration calculated in S770.

In S800, the angular velocity calculated in S790 is integrated for a sampling time. In the following S810, the initial integral of the angular velocity is updated. This initial integral is the integral of the angular velocity for a past given time. Since the angular velocity has been additionally calculated in S790, the integral of the angular velocity that has been obtained for a sampling time more than a given time ago is removed from the initial integral in S810.

In the following S820, the first rotation angle [rad] about the Z axis related to the hammer drill 2 is calculated by addition of the initial integral of the angular velocity updated in S810 and the latest integral of the angular velocity calculated in S800.

In S830, the second rotation angle of the hammer drill 2 required for actually stopping the motor 8 after twisting of the hammer drill 2 about the Z axis is detected is calculated based on the current angular velocity determined in S790. The process then proceeds to S840. This rotation angle is calculated by multiplying the angular velocity by a predetermined estimated time (rotation angle=angular velocity× estimated time).

In S840, an estimated angle is calculated by adding the second rotation angle calculated in S830 to the first rotation angle about the Z axis calculated in S820. This estimated angle corresponds to the rotation angle about the Z axis including the rotation angle after a stop of drive of the motor 8 (i.e., the second rotation angle).

In S850, whether the state where the estimated angle calculated in S840 exceeds a threshold angle predetermined to detect a twisted-motion has continued for more than a given time is determined.

If yes in S850, the process proceeds to S860 to transmit an error signal to the control circuit 80. In other words, the fact that the tool bit 4 fits the work piece during drilling of the work piece and a twisted-motion of the hammer drill 2 has started is notified to the control circuit 80.

Consequently, the control circuit 80 determines that the motor drive conditions are not satisfied and stops drive of the motor 8, thereby restraining a large amount of twisting of the hammer drill 2. After execution of the process in S860, this process proceeds to S710 again.

On the contrary, if no in S850, the process proceeds to S870 to transmit a no-error signal to the control circuit 80. In other words, the fact that the hammer drill 2 is not twisted is notified to the control circuit 80. After execution of the process in S870, this process proceeds to S710 again.

In S720, if it is determined that the trigger switch 18*a* is not in the on state, the operation of the hammer drill 2 stops; thus, the process proceeds to S880 to reset the integrals and the initial integrals of angular acceleration and angular velocity. The process then proceeds to S870.

As described above, in the hammer drill 2 in this embodiment, the control circuit 80 in the motor controller 70 executes the current load detection process shown in FIG. 9 to determine whether the tool bit 4 is in the no-load state or the load state, in accordance with the current flowing through the motor 8 (load imposition or no-load imposition is detected in accordance with a current).

Since the acceleration detecting circuit 94 of the twisted-motion detector 90 executes the acceleration load detecting process shown in FIG. 12, whether the tool bit 4 is in the no-load imposed state or the load imposed state is determined in accordance with accelerations detected in the directions of the X axis, the Y axis, and the Z axis by the acceleration sensor 92 (load imposition or no-load imposition is detected in accordance with accelerations).

When load imposition is not detected in accordance with a current or accelerations and the dust collector device 66 is not mounted to the hammer drill 2, the control circuit 80 limits the rotational speed of the motor 8 at or below the no-load rotational speed Nth in the soft no load process shown in FIG. 8.

Accordingly, in the hammer drill 2 of this embodiment, if the drive mode is in the hammer mode, load imposition on the tool bit 4 can be detected in the acceleration load detecting process. If the drive mode is in the drill mode, load imposition on the tool bit 4 can be detected in the current load detection process. If the drive mode is in the hammer drill mode, load imposition on the tool bit 4 can be detected in both the acceleration load detecting process and the current load detection process.

Hence, in the hammer drill 2 of this embodiment, in any drive mode selected from the group including the hammer mode, the hammer drill mode, and the drill mode, load imposition from the work piece to the tool bit 4 can be rapidly detected and the motor 8 can be driven at a command rotational speed.

Further, in the hammer drill 2 of this embodiment, when the dust collector device 66 is mounted to the hammer drill 2, the motor 8 is driven at a command rotational speed even if at least one of the detection of a load based on current flowing through the motor 8 and the detection of a load based on acceleration detected by the acceleration sensor 92 is not performed. In this hammer drill 2, mounting the dust collector device 66 to the hammer drill 2 restrains vibrations of the main body housing 10, so that soft no load control is not executed even if the detection of the load conditions of the tool bit 4 is difficult in the acceleration load detecting process. Accordingly, the user can perform chipping or drilling of the work piece as usual.

In this embodiment, the current load detection process executed in the control circuit 80 functions as one example of a first load detector of the present disclosure, and the acceleration load detecting process executed by the acceleration detecting circuit 94 functions as one example of a second load detector of the present disclosure.

In the acceleration load detecting process, accelerations in the directions of the three axes (X, Y, and Z) sent from the acceleration sensor 92 is subjected to A/D conversion, and the obtained acceleration data is subjected to a filtering process. Through this filtering process, a gravity acceleration component is removed from acceleration data related to each axis direction.

This filtering process yields high accuracy of acceleration detection, compared with removing a gravity acceleration component through transmission of a detection signal from the acceleration sensor 92 to an analog filter (a high-pass filter).

To be specific, upon generation of acceleration due to the vibration of the main body housing 10, a detection signal from the acceleration sensor 92 fluctuates according to the acceleration, whereas when no electric power is supplied to the hammer drill 2, the fluctuation of the detection signal is centered around the ground potential.

Figure 14:
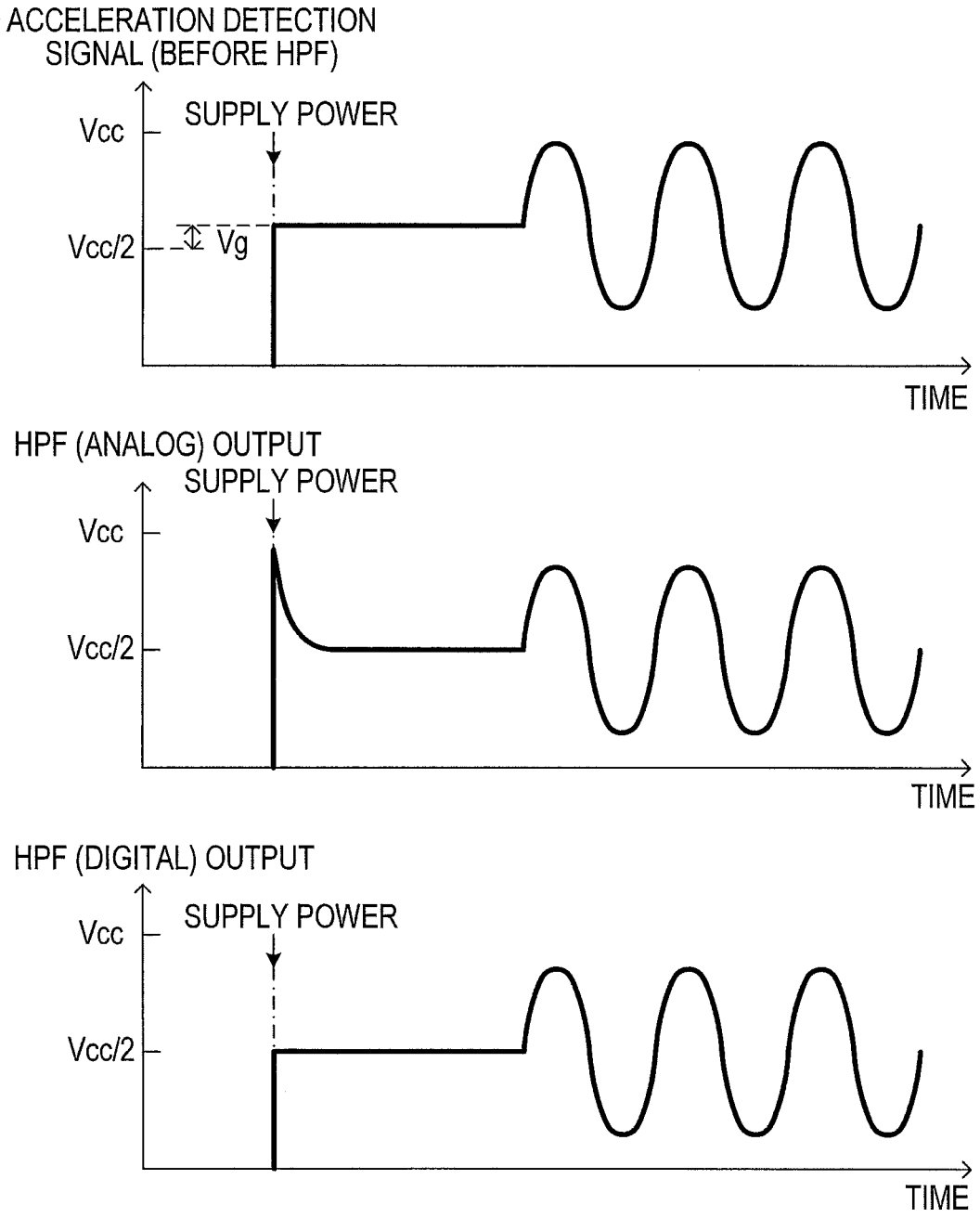
FIG. 14 is a diagram for explaining an operation of a high-pass filter in detection process shown in FIGS. 12, 13A, and 13B by a comparison with that of an analog filter.

As shown in the upper diagram in FIG. 14, when the hammer drill 2 is supplied with electric power, the fluctuation of the detection signal is centered around a raised voltage determined by adding a gravity acceleration component (Vg) to the reference voltage of the input circuit (typically the middle voltage of the power source voltage Vcc: Vcc/2).

Since the motor 8 is stopped immediately after the hammer drill 2 is supplied with electric power, no acceleration is assumed to occur in the main body housing 10. Accordingly, an input signal (a detection signal) from the acceleration sensor 92 rises to a constant voltage of "(Vcc/2)+Vg".

In this case, a detection signal is input to an analog filter (high-pass filter: HPF) to remove gravity acceleration components (Vg); thus, as shown in the middle drawing of FIG. 14, the output of the analog filter rapidly rises immediately after supply of electric power and exceeds the reference voltage (Vcc/2). Afterwards, the output of the analog filter eventually decreases to the reference voltage (Vcc/2) and goes into the stable state but after a certain period of time.

On the contrary, if a detection signal is subjected to a filtering process using a digital filter as in this embodiment, as shown in the lower drawing of FIG. 14, the signal level of the detection signal can be set to the initial value immediately after supply of electric power, thereby restraining or preventing the fluctuation of the detection signal (data).

Accordingly, in this embodiment, accelerations can be accurately detected from immediately after supply of electric power to the hammer drill 2, thereby the risk that the load imposition on the tool bit, which are caused by acceleration detection errors, cannot be detected is restrained.

Further, the twisted-motion detector 90 is separate from the motor controller 70, which leads to a smaller size than that given by integration of these components. Accordingly, the twisted-motion detector 90 can be disposed in a position where it can easily detect the behavior (acceleration) of the main body housing 10, using a space in the main body housing 10.

In addition, in the current load detection process, the time during which the detected current value exceeds the current threshold Ith and the time during which the detected current value does not exceed the current threshold Ith are measured using the load counter and the no-load counter. A load or no-load on the tool bit 4 is confirmed based on the detected current when these times reach given set times depending on the determination values T1 and T2. For this reason, in this embodiment, failures in determination of a current load caused by noise and the like can be restrained.

Figure 15:
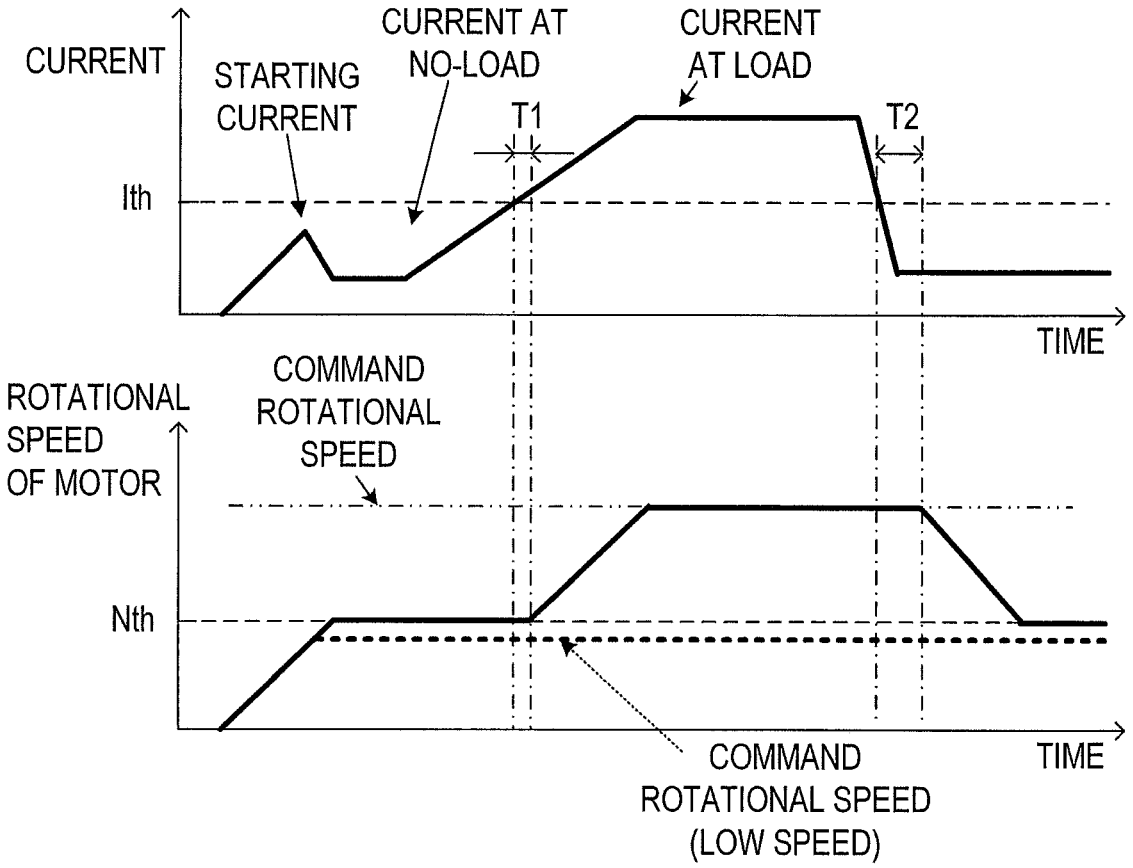
FIG. 15 is a time chart showing determination of a load and no-load and an operation of rotational speed control.

In particular, in this embodiment, as shown in FIG. 15, the load determination value T1 used to determine the load conditions after the detected current exceeds the current threshold Ith is set lower (shorter) than the no-load determination value T2 used to determine the no-load conditions after the detected current becomes at or below the current threshold Ith.

For this reason, in this embodiment, the load conditions of the tool bit 4 can be detected earlier than the no-load conditions, thereby shortening the delay time upon switching of the rotational speed of the motor 8 from the no-load rotational speed Nth to a command rotational speed.

Accordingly, in this embodiment, the rotational speed of the motor 8 rapidly rises when a load is imposed on the tool bit 4, so that the user can satisfactorily perform chipping or drilling of the work piece. In addition, in this embodiment, switching of the motor's rotational speed to low speed due to the detection of the no-load conditions can be restrained in the middle of chipping operation.

In the acceleration load detecting process, as in the current load detection process, the time during which average acceleration exceeds a threshold and the time during which the average acceleration is at or below the threshold may be measured, and when they reach given set times, a load or no-load on the tool bit 4 may be confirmed.

Further, in this embodiment, the user can set the upper limit rotational speed through a dial operation on the upper-limit speed setter 96. In addition, the user can set the command rotational speed of the motor 8, which is determined according to a signal from the speed change commander 18*b*, lower than the no-load rotational speed Nth through a trigger operation.

When the command rotational speed is set lower than the no-load rotational speed Nth, the rotational speed of the motor 8 becomes the command rotational speed as indicated by the dotted line in FIG. 15. Hence, the user can operate the motor 8 at a speed lower than the no-load rotational speed Nth, thereby widening the range of use of the hammer drill 2 and improving usability.

Although the embodiment for implementing the present disclosure has been described so far, the present disclosure is not limited to the above-described embodiment and various modifications can be made for implementation.

For example, in the above-described embodiment, a load on the tool bit 4 is detected using current flowing through the motor 8, which is information about the drive state of the motor, and acceleration imposed on the main body housing 10.

However, the present disclosure is not limited to this and the load conditions of the tool bit may be determined using motor's rotational speed (specifically variations in speed), motor's drive voltage (specifically variations in voltage), or the like instead of current flowing through the motor 8. In addition, an angular velocity sensor may be used as a sensor for detecting the behavior of the hammer drill main body, instead of the acceleration sensor 92. An angle sensor may detect vibrations of the main body housing 10 to detect load imposition on the tool bit.

In addition, in the above-described embodiment, the acceleration load detecting process uses all the accelerations in the directions of the three axes (X, Y, and Z) detected by the acceleration sensor 92. However, load imposition on the tool bit 4 due to a hammering operation can be detected using at least the acceleration of the direction of the Z axis.

Further, in the above-described embodiment, the hammer drill 2 that can be attached with the dust collector device 66 which is an external unit is described. However, the hammer drill may be attached with a water injection device for injecting water to a portion of a work piece being processed, a lighting device for illuminating a work piece, a blower for giving air to blow dust particles, or the like that is an external unit. When attached with any of these external units, such a hammer drill may be configured to drive the motor 8 at a command rotational speed even if neither the current-based detection of a load nor the acceleration-based detection of a load has been performed.

When any of these external units is attached to the hammer drill, the main body housing 10 barely vibrates, hindering the detection of load imposition on the tool bit. For this reason, when any external unit is attached, soft no load control may not be executed and the motor 8 may be driven in accordance with a command from the user. Consequently, when any external unit is attached, the risk that the motor 8 cannot be driven at a command rotational speed set by the user due to the execution of soft no load control can be reduced.

Multiple functions of one component in the above-described embodiment may be implemented by multiple components, or one function of one component may be implemented by multiple components. In addition, multiple functions of multiple components may be implemented by one component, or one function implemented by multiple components may be implemented by one component. Further, part of the structure of the above-described embodiment can be omitted. Moreover, at least part of the above-described embodiment can be added to or replaced by another structure of the above-described embodiment. It should be noted that any mode included in technical ideas specified by the words in the claims is the embodiment of the present disclosure.

What is claimed is:

1. An electric power tool comprising:

a main body;

a motor that is provided to the main body;

a tool holder that is provided to the main body and configured to hold a tool bit such that the tool bit is reciprocatable in an axial direction of the tool bit;

a hammer that is provided to the main body and is configured to reciprocate the tool bit held by the tool holder in the axial direction to hammer a work piece;

a motion converter that is provided to the main body and is configured to convert rotation of the motor to linear motion and transmit the linear motion to the hammer;

a rotation transmitter that is provided to the main body and is configured to transmit the rotation of the motor to the tool holder and rotatively drive the tool bit in a circumferential direction of the tool bit;

a first load detector that is configured to detect, based on information indicating a drive state of the motor, a load imposed from the work piece to the tool bit;

a second load detector that is configured to detect, based on information indicating a behavior of the main body, a load imposed from the work piece to the tool bit;

a motor controller that is configured to control drive of the motor based on a command rotational speed commanded from an outside of the electric power tool, the motor controller being configured to set an upper limit of rotational speed of the motor to a predetermined no-load rotational speed in response to no-load on the tool bit being detected by both the first load detector and the second load detector; and a mode switcher that is configured to selectively set a drive mode of the tool bit to any one of a hammer mode, a hammer drill mode, and a drill mode, the hammer mode being a mode in which the tool bit reciprocates in the axial direction, the hammer drill mode being a mode in which the tool bit reciprocates in the axial direction and rotates in the circumferential direction, and the drill mode being a mode in which the tool bit rotates in the circumferential direction.

2. The electric power tool according to claim 1, wherein the mode switcher is configured to selectively transmit the rotation of the motor to the motion converter and/or the rotation transmitter to selectively set the drive mode.

3. The electric power tool according to claim 1, wherein the first load detector includes a current detector that is configured to detect a value of current flowing through the motor, the first load detector being configured to detect a load on the tool bit in response to the value of the current detected by the current detector exceeding a predetermined first threshold, and the second load detector includes an acceleration sensor that is configured to detect at least acceleration of the main body in the axial direction of the tool bit, the second load detector being configured to detect a load on the tool bit in response to the acceleration detected by the acceleration sensor exceeding a predetermined second threshold.

4. The electric power tool according to claim 3, wherein the acceleration sensor is configured to output a detection signal indicating the detected acceleration, and the second load detector is configured to detect a load on the tool bit based on an acceleration that is calculated based on the detection signal with an unwanted low-frequency signal component removed by a high pass filter.

5. The electric power tool according to claim 4, wherein the high-pass filter includes a digital filter.

6. The electric power tool according to claim 1, wherein the second load detector is separated from the motor controller.

7. The electric power tool according to claim 1, wherein the motor controller is configured to rotate the motor at a constant speed corresponding to the command rotational speed or the no-load rotational speed.

8. The electric power tool according to claim 1, wherein the motor controller is configured to gradually change the rotational speed of the motor upon switching from no-load conditions to load conditions, the no-load conditions being conditions in which no-load on the tool bit is detected, and the load conditions being conditions in which a load on the tool bit is detected.

9. The electric power tool according to claim 1, wherein the motor controller is configured to gradually change the rotational speed of the motor upon switching from load conditions to no-load conditions, the load conditions being conditions in which a load on the tool bit is detected, and the no-load conditions being conditions in which no-load on the tool bit is detected.

10. An electric power tool comprising:

a main body;

a motor that is provided to the main body;

a tool holder that is provided to the main body and configured to hold a tool bit such that the tool bit is reciprocatable in an axial direction of the tool bit;

a hammer that is provided to the main body and is configured to reciprocate the tool bit held by the tool holder in the axial direction to hammer a work piece;

a motion converter that is provided to the main body and is configured to convert rotation of the motor to linear motion and transmit the linear motion to the hammer;

a rotation transmitter that is provided to the main body and is configured to transmit the rotation of the motor to the tool holder and rotatively drive the tool bit in a circumferential direction of the tool bit;

a first load detector that is configured to detect, based on information indicating a drive state of the motor, a load imposed from the work piece to the tool bit;

a second load detector that is configured to detect, based on information indicating a behavior of the main body, a load imposed from the work piece to the tool bit; and a motor controller that is configured to control drive of the motor based on a command rotational speed commanded from an outside of the electric power tool, the motor controller being configured to set an upper limit of rotational speed of the motor to a predetermined no-load rotational speed in response to no-load on the tool bit being detected by both the first load detector and the second load detector, wherein:

the first load detector includes a current detector that is configured to detect a value of current flowing through the motor, the first load detector being configured to detect a load on the tool bit in response to the value of the current detected by the current detector exceeding a predetermined first threshold, the second load detector includes an acceleration sensor that is configured to detect at least acceleration of the main body in the axial direction of the tool bit, the second load detector being configured to detect a load on the tool bit in response to the acceleration detected by the acceleration sensor exceeding a predetermined second threshold, and the first load detector is configured to measure a first time and a second time, to detect a load on the tool bit in response to the first time reaching a first threshold time, and to detect no-load on the tool bit in response to the second time reaching a second threshold time, the first time being a time period during which the value of the current exceeds the first threshold, the second time being a time period during which the value of the current is equal to or less than the first threshold, and the first threshold time and the second threshold time being different from each other.

11. The electric power tool according to claim 10, wherein the first threshold time is shorter than the second threshold time.

12. An electric power tool comprising:

a main body;

a motor that is provided to the main body;

a tool holder that is provided to the main body and configured to hold a tool bit such that the tool bit is reciprocatable in an axial direction of the tool bit;

a hammer that is provided to the main body and is configured to reciprocate the tool bit held by the tool holder in the axial direction to hammer a work piece;

a motion converter that is provided to the main body and is configured to convert rotation of the motor to linear motion and transmit the linear motion to the hammer;

a rotation transmitter that is provided to the main body and is configured to transmit the rotation of the motor to the tool holder and rotatively drive the tool bit in a circumferential direction of the tool bit;

a first load detector that is configured to detect, based on information indicating a drive state of the motor, a load imposed from the work piece to the tool bit;

a second load detector that is configured to detect, based on information indicating a behavior of the main body, a load imposed from the work piece to the tool bit; and a motor controller that is configured to control drive of the motor based on a command rotational speed commanded from an outside of the electric power tool, the motor controller being configured to set an upper limit of rotational speed of the motor to a predetermined no-load rotational speed in response to no-load on the tool bit being detected by both the first load detector and the second load detector, wherein:

the first load detector includes a current detector that is configured to detect a value of current flowing through the motor, the first load detector being configured to detect a load on the tool bit in response to the value of the current detected by the current detector exceeding a predetermined first threshold, the second load detector includes an acceleration sensor that is configured to detect at least acceleration of the main body in the axial direction of the tool bit, the second load detector being configured to detect a load on the tool bit in response to the acceleration detected by the acceleration sensor exceeding a predetermined second threshold, and the second load detector is configured to measure a third time and a fourth time, to detect a load on the tool bit in response to the third time reaching a third threshold time, and to detect no-load on the tool bit in response to the fourth time reaching a fourth threshold time, the third time being a time period during which the acceleration exceeds the second threshold, the fourth time being a time period during which the acceleration is equal to or less than the second threshold, and the third threshold time and the fourth threshold time being different from each other.

13. The electric power tool according to claim 12, wherein the third threshold time is shorter than the fourth threshold time.

14. An electric power tool comprising:

a main body;

a motor that is provided to the main body;

a tool holder that is provided to the main body and configured to hold a tool bit such that the tool bit is reciprocatable in an axial direction of the tool bit;

a hammer that is provided to the main body and is configured to reciprocate the tool bit held by the tool holder in the axial direction to hammer a work piece;

a motion converter that is provided to the main body and is configured to convert rotation of the motor to linear motion and transmit the linear motion to the hammer;

a rotation transmitter that is provided to the main body and is configured to transmit the rotation of the motor to the tool holder and rotatively drive the tool bit in a circumferential direction of the tool bit;

a first load detector that is configured to detect, based on information indicating a drive state of the motor, a load imposed from the work piece to the tool bit;

a second load detector that is configured to detect, based on information indicating a behavior of the main body, a load imposed from the work piece to the tool bit;

a motor controller that is configured to control drive of the motor based on a command rotational speed commanded from an outside of the electric power tool, the motor controller being configured to set an upper limit of rotational speed of the motor to a predetermined no-load rotational speed in response to no-load on the tool bit being detected by both the first load detector and the second load detector;

an upper-limit speed setter that is configured to be operated by an operator of the electric power tool and to set an upper limit of the command rotational speed; and a speed change commander that is configured to be operated by the operator and to change the command rotational speed in accordance with an amount of operation, wherein the motor controller is configured to set the command rotational speed according to the amount of operation of the speed change commander, using the upper limit, which is set by the upper-limit speed setter, as a maximum rotational speed.

15. The electric power tool according to claim 14, wherein the no-load rotational speed is a constant rotational speed, and the upper-limit speed setter is configured to be able to set the upper limit of the command rotational speed to a rotational speed in a range of a rotational speed higher than the no-load rotational speed to a rotational speed lower than the no-load rotational speed.

16. An electric power tool comprising:

a main body;

a motor that is provided to the main body;

a tool holder that is provided to the main body and configured to hold a tool bit such that the tool bit is reciprocatable in an axial direction of the tool bit;

a hammer that is provided to the main body and is configured to reciprocate the tool bit held by the tool holder in the axial direction to hammer a work piece;

a motion converter that is provided to the main body and is configured to convert rotation of the motor to linear motion and transmit the linear motion to the hammer;

a rotation transmitter that is provided to the main body and is configured to transmit the rotation of the motor to the tool holder and rotatively drive the tool bit in a circumferential direction of the tool bit;

a first load detector that is configured to detect, based on information indicating a drive state of the motor, a load imposed from the work piece to the tool bit;

a second load detector that is configured to detect, based on information indicating a behavior of the main body, a load imposed from the work piece to the tool bit; and a motor controller that is configured to control drive of the motor based on a command rotational speed commanded from an outside of the electric power tool, the motor controller being configured to set an upper limit of rotational speed of the motor to a predetermined no-load rotational speed in response to no-load on the tool bit being detected by both the first load detector and the second load detector, wherein:

the main body is configured to be able to be attached with an external unit, and the motor controller is configured to change, in response to the external unit being attached to the main body, conditions under which the upper limit of the rotational speed of the motor is set to the no-load rotational speed.

17. The electric power tool according to claim 16, wherein the motor controller is configured to control, in response to the external unit being attached to the main body, drive of the motor in accordance with the command rotational speed independently of detection results from the first load detector and the second load detector.

* * * * *